US006234470B1

(12) United States Patent
Okitsu et al.

(10) Patent No.: US 6,234,470 B1
(45) Date of Patent: May 22, 2001

(54) SHEET MATERIAL FEEDING APPARATUS

(75) Inventors: Katsuhiko Okitsu; Masashi Shimamura, both of Chichibu (JP)

(73) Assignee: Canon Denshi Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/266,581

(22) Filed: Mar. 11, 1999

(30) Foreign Application Priority Data

Mar. 18, 1998 (JP) ..... 10-089209
Mar. 18, 1998 (JP) ..... 10-089212

(51) Int. Cl.[7] ..... B65H 1/00; B65H 5/00; B65H 3/44

(52) U.S. Cl. ..... 271/114; 271/122; 271/9.09; 271/10.11; 271/258.01

(58) Field of Search ..... 271/226, 220, 271/122, 114, 115, 116, 117, 110, 258.01, 9.09, 10.11

(56) References Cited

U.S. PATENT DOCUMENTS 5,350,170 * 9/1994 Emigh et al. ..... 271/273 X
5,575,466 * 11/1996 Tranquilla ..... 271/10.03
5,664,771 * 9/1997 Nagatani et al. ..... 271/10.03
5,678,817 * 10/1997 Saito et al. ..... 271/122
5,755,336 * 5/1998 Rudy ..... 209/539 X
5,910,951 * 5/1999 Yamaguchi ..... 271/10.11
6,000,689 * 12/1999 Furuki et al. ..... 271/10.11

FOREIGN PATENT DOCUMENTS 196 05 106 8/1996 (DE) .
2 230 763 10/1990 (GB) .
62-185648 8/1987 (JP) .

* cited by examiner

*Primary Examiner*—Joseph E. Valenza
*Assistant Examiner*—Kenneth W Bower
(74) *Attorney, Agent, or Firm*—Fitzpatrick, Cella, Harper & Scinto

(57) ABSTRACT

A feeding rotatable member, a conveying rotatable member and a separating rotatable member are driven by a sheet feeding motor, a feeding motor and a separating motor, respectively, which are independent driving means to thereby feed an original. The separation and conveyance of the original are effected while the opening amount between the conveying rotatable member and the separating rotatable member is changed by a sheet thickness adjusting motor.

38 Claims, 16 Drawing Sheets

SHEET MATERIAL FEEDING APPARATUS

BACKGROUND OF THE INVENTION

1. Field of the Invention

This invention relates to a sheet material feeding apparatus for feeding sheet materials, a sheet material processing apparatus for effecting predetermined processing on sheet materials, and an image reading apparatus for reading the images of sheet-like originals.

2. Related Background Art

FIG. 19 of the accompanying drawings shows the construction of the essential portions of an image reading apparatus according to the prior art.

The reference numeral 1 designates an original supporting table, the reference numeral 2 denotes a driving motor for vertically driving the original supporting table, and the reference numeral 3 designates detecting means for detecting that originals have been moved up to a predetermined position.

The reference numeral 4 denotes a sheet feeding roller for moving the originals to a separating and feeding position, and the reference numeral 205 designates a sheet feeding clutch for changing over the ON/OFF of the driving of the sheet feeding roller 4.

The reference numeral 6 denotes a feeding roller, and the reference numeral 7 designates a separating roller of a comb-tooth like shape and roller portions exist alternately. The reference numeral 208 denotes a feeding clutch for switching ON/OFF the driving of the feeding roller 6, and the reference numeral 209 designates a separating clutch for switching ON/OFF the driving of the separating roller 7.

The reference numeral 10 denotes a conveying motor which is the drive source of the entire apparatus.

The reference numeral 13 designates a sheet feeding sensor which detects that an original has been separated and conveyed. The reference numerals 14 and 15 denote original reading sensors which read the image information of the front and back surfaces of conveyed originals. The reference numeral 16 designates a sheet discharge sensor which detects that the original F has passed a conveyance path and has been discharged.

The reference numerals 20, 21, 22 and 23 denote original conveying rollers which convey and drive the original F.

The reference numeral 40 designates an upper guide plate, and the reference numeral 41 denotes a lower guide plate, and the original F is conveyed between these two guide plates.

The reference numeral 30 designates a sheet thickness adjusting knob which moves up and down the feeding roller 6 to thereby change the spacing of a separating and conveying portion.

The operations of these are as follows.

When a plurality of originals F are stucked on the original supporting table 1 and a reading start signal is outputted from input means, not shown, the original supporting table driving motor 2 is rotatively driven to move up the original supporting table 1.

The originals F on the original supporting table 1 are gradually moved up, and the original supporting table driving motor is driven until the originals F are detected by the original detecting sensor 3, and is stopped at a point of time whereat the originals have been detected by the original detecting sensor 3.

Next, when the sheet feeding clutch 205 becomes ON, the driving of the conveying motor 10 is transmitted to the sheet feeding roller 4 to thereby rotatively drive the sheet feeding roller 4, thus conveying the original F to a conveying and separating portion.

The feeding roller 6 and the separating roller 7 are generally controlled so as to start driving simultaneously with the sheet feeding roller 4, and separate and convey the original F fed from the sheet feeding portion by the sheet feeding roller 4.

The original F is separated at a sheet separating and feeding portion by the following operation.

The original F conveyed to the sheet separating and feeding portion by the sheet feeding roller 4 is driven in the feeding direction by the feeding roller 6 and at the same time, has a force in the opposite direction imparted thereto by the separating roller 7.

Thereby, even if as shown in FIG. 20, a plurality of originals are fed at a time to the separating and conveying portion, only the upper original F1 is fed forwardly and the lower original F2 is returned reversely by the separating roller 7, thus preventing the double feeding of the originals.

The adjustment of the spacing between the two rollers 6 and 7 is effected by the use of the sheet thickness adjusting knob 30.

When as shown in FIG. 21, the spacing between the rollers of the separating and conveying portion is narrow, the original F is pushed back in a direction opposite to the direction of conveyance by the separating roller 7 and is not fed. Also, when as shown in FIG. 22, the aforementioned spacing is wide, if the force the second original F2 receives from the separating roller 7 is less than the static frictional force between the original F and the original F2, the two originals are conveyed at a time, thus causing double feed.

Therefore, it is necessary to change the sheet thickness adjusting knob 30 in conformity with the kind of the original to be read.

The original F which has passed the separating and conveying portion is detected by the sheet feeding sensor 13, and by the signal thereof, the sheet feeding clutch 205 and the feeding clutch 208 are disengaged to thereby once stop the driving of the sheet feeding roller 4 and the feeding roller 6 so that the second and subsequent originals F2 may not be continuously fed.

The separating roller 7 continues to reversely drive while the sheet feeding sensor 13 is detecting the original F so that the second and subsequent originals F2 may not be fed by being dragged by the original F1.

Via this process of separation and conveyance, the original F passes the reading sensors 14 and 15 and the read image thereof is sent to an image processing portion, not shown.

When a plurality of originals are to be continuously processed, the sheet feeding clutch 205 and the feeding clutch 208 are again engaged at a point of time whereat the sheet feeding sensor 13 has come not to detect the original F, and the sheet feeding roller 4 and the feeding roller 6 are driven to thereby begin to separate and convey the original F2.

At a point of time whereat the original detecting sensor 2 has come to detect no original even if the original supporting table 1 is moved up to its uppermost position, it is judged that all originals have been read and conveyed, and at a point of time whereat the discharging of the original F has been detected, the conveying motor 10 and the separating clutch 9 are deenergized, and then the original supporting table driving motor 2 is reversely rotated to thereby move the original supporting table 1 to its lowermost position, whereafter all operations are completed.

In the aforedescribed original conveying method according to the prior art, the sheet feeding roller, the feeding roller and the separating roller are controlled by the ON/OFF of the clutches, and the driving force is supplied from the conveying motor 10 through the gears, the belt, etc. and all the rollers are rotated at the same rotational proportion in any state.

Also, when the original reading speed and resolution are to be changed by changing the conveying speed of the conveying motor, the speeds of the sheet feeding roller, the feeding roller and the separating roller fluctuate at the same proportion, and the separating and conveying system which should originally be determined by the coefficient of dynamic friction between the originals and the coefficients of friction among the rollers also fluctuates and separation and conveyance are-effected in an unstable state, and this gives rise to a problem such as double feed.

Also, the operations of the rollers take place at a predetermined proportion through the gears and the belt and therefore, even if the state, quality, etc. of the originals changed, it is difficult to change and optimize the separating and conveying system, and it is also a cause of double feed that an external factor cannot be coped with.

In the construction as well, a number of gears and belts for deceleration and acceleration become necessary to adjust the rotational proportion of the rollers, and this makes the mechanical construction complicated and at the same time, leaves problems in maintenance property and stability. Regarding also the adjustment of the thickness of the sheets, only manual adjustment is possible and this is cumbersome, and when originals of different thicknesses are mixed, problems such as bad conveyance and double feed arise and remarkably aggravate the working property.

SUMMARY OF THE INVENTION

The present invention has been made in order to solve such problems peculiar to the prior art and the object thereof is to prevent the bad conveyance, double feed or the like of sheet materials and achieve an improvement in separating and conveying performance.

To achieve the above object, the present invention provides a sheet material feeding apparatus provided with a feeding rotatable member for feeding a sheet material from a predetermined feeding position, and separating and conveying means for conveying the sheet material fed by the feeding rotatable member and separating double-fed sheet materials, characterized in that the separating and conveying means is provided with a conveying rotatable member rotated in a sheet material conveying direction, and a separating rotatable member for holding the sheet material between itself and the conveying rotatable member, and rotated in a direction opposite to the sheet material conveying direction, and the feeding rotatable member, said conveying rotatable member and the separating rotatable member are driven by respective independent driving means.

This construction can uniquely control the driven state of each rotatable member and therefore, the setting of appropriate separating and conveying conditions conforming to various sheet materials and various conveying states becomes possible and an improvement in separating and conveying performance can be achieved.

Also, the rotatable members do not share a driving means and therefore, drive transmitting means such as gears and belts can be eliminated and thus, the structure of the apparatus can be simplified and the number of parts can be curtailed to thereby achieve a reduction in cost, the shortening of the assembling time and an improvement in serviceability.

Also, driving means for at least one of the feeding rotatable member, the conveying rotatable member and the separating rotatable member can be fed by step.

This construction can have more various rotation states than in case where each rotatable member is rotated continuously. Accordingly, proper separation and conveyance condition in accordance with the sheet materials and conveying condition can be set, thereby an improvement in separating and conveying performance can be achieved.

Also, design may be made such that at least two of the feeding rotatable member, the conveying rotatable member and the separating rotatable member are driven in synchronism with each other.

Also, design may be made such that at least two of the feeding rotatable member, the conveying rotatable member and the separating rotatable member are driven in non-synchronism with each other.

Also, provision may be made of driving method switching means for switching at least two of the feeding rotatable member, the conveying rotatable member and the separating rotatable member to a case where they are driven in synchronism with each other and a case where they are driven in non-synchronism with each other.

Also, design may be made such that a driving method switching means is provided for switching a case where at least two of the feeding rotatable member, the conveying rotatable member and the separating rotatable member are driven in synchronism with each other, and a case where at least two of the feeding rotatable member, the conveying rotatable member and the separating rotatable member are driven in non-synchronism with each other.

Also, design may be made such that a case where at least two of the feeding rotatable member, the conveying rotatable member and the separating rotatable member are driven in synchronism with each other and a case where at least two of the feeding rotatable member, the conveying rotatable member and the separating rotatable member are driven in non-synchronism with each other are switched in the process of the separating and conveying operation.

If as described above, design is made such that at least two of the feeding rotatable member, the conveying rotatable member and the separating rotatable member are driven in synchronism or non-synchronism with each other, or are driven with the synchronism/non-synchronism changed over by the driving method switching means, or the synchronism/non-synchronism is changed over in the process of the separating and conveying operation, there can be obtained separating and conveying performance suited for various sheet materials and various separating and conveying states.

Also, provision may be made of spacing adjusting means for changing the spacing between the conveying rotatable member and the separating rotatable member.

By changing the spacing between the conveying rotatable member and the separating rotatable member as described above, the separated and conveyed state of the sheet material can be changed and therefore, there can be obtained separating and conveying performance conforming to the sheet material.

Also, in the original separating and conveying operation, the spacing between the conveying rotatable member and the separating rotatable member may be changed so that the changing speed of the spacing may change in conformity with the spacing.

In this construction, it never happens that the spacing becomes too great even when the sheet material is thin, and even when the sheet material is thick, the time for changing the spacing can be shortened, and there can be obtained separating and conveying performance conforming to the sheet material.

Also, design may be made such that with the original separating and conveying operation, the spacing between the conveying rotatable member and the separating rotatable member is changed and correction is effected so that the spacing may assume a predetermined size, and the amount of correction is changed in conformity with the spacing.

In this case, as when the sheet material is a thin sheet material liable to be damaged or contaminated during separation and conveyance or a thick and hard sheet material suffering little from such possibility, the amount of correction of the spacing between the conveying rotatable member and the separating rotatable member can be changed in conformity with the kind of the sheet material and therefore, there can be obtained separating and conveying performance suited for the sheet material.

Also, when a plurality of sheet materials are to be fed, if the sheet material next to the sheet material which has passed the separating and conveying means is already held by the separating and conveying means, the spacing between the conveying rotatable member and the separating rotatable member may be made smaller while the conveying rotatable member is reversely rotated.

In this construction, the sheet material held by the separating and conveying means is returned to the upstream side of the separating and conveying means with respect to the direction of conveyance and therefore, even when a plurality of sheet materials are to be fed, each sheet material can be conveyed in a similar separated and conveyed state, and the separating and conveying performance is improved.

Also, design may be made such that when the sheet material does not normally pass the separating and conveying means, the setting of the control conditions of the separating and conveying means is changed and the next separating and conveying operation is performed.

In this construction, even when bad conveyance or double feed or the like occurs and the sheet material does not normally pass the separating and conveying means, the setting of the control conditions of the separating and conveying means is changed and the occurrence of bad conveyance or the like by a similar cause can be prevented and therefore, good separating and conveying performance can be obtained.

Also, double feed detecting means for detecting the double feed of sheet materials may be provided downstream of the separating and conveying means with respect to the direction of conveyance of the sheet material, and design may be made such that the sheet material separating and conveying operation is performed while the spacing between the conveying rotatable member and the separating rotatable member is changed by the spacing adjusting means, and when double feed is detected by the double feed detecting means, the feeding rotatable member and the conveying rotatable member are stopped, and the spacing between the conveying rotatable member and the separating rotatable member is restored to its initial state while the separating rotatable member is rotated in a direction opposite to the sheet material conveying direction, whereby the double-fed sheet materials are discharged from the separating and conveying means.

In this construction, the automatization and higher efficiency of the work of avoiding the double feeding of sheet materials can be achieved.

Also, double feed detecting means for detecting the double feed of sheet materials may be provided downstream of the separating and conveying means with respect to the sheet material conveying direction, and design may be made such that the sheet material separating and conveying operation is performed while the spacing between the conveying rotatable member and the separating rotatable member is changed by the spacing adjusting means, and when double feed is detected by the double feed detecting means, the spacing between the conveying rotatable member and the separating rotatable member is restored to its initial state while the feeding rotatable member and the conveying rotatable member are rotated in a direction opposite to the sheet material conveying direction, whereby the sheet materials are discharged from the separating and conveying means.

In this construction, the automatization and higher efficiency of the work of avoiding the double feed of sheet materials can be achieved.

Also, when the feeding of the sheet material is to be effected again after the double feed detecting means has detected double feed, the setting of the control conditions of the separating and conveying operation may be made different from that when double feed occurs.

In this construction, the occurrence of double feed by a similar cause can be prevented and good separating and conveying performance can be obtained.

Also, the synchronous and non-synchronous relationship of the driving of at least two of the feeding rotatable member, the conveying rotatable member and the separating rotatable member may be changed during the occurrence of double feed and after the detection of double feed.

In this construction, the setting of the control conditions of the separating and conveying operation is changed during the occurrence of double feed and after the detection of double feed and therefore, the occurrence of double feed by a similar cause can be prevented and good separating and conveying performance can be obtained.

Also, provision may be made of mode changeover means having a plurality of separating and conveying modes in which the setting of the control conditions of the sheet material separating and conveying operation differs, and changing over the separating and conveying modes.

In this construction, good separating and conveying performance can be obtained by changing over the separating and conveying modes so that an appropriate separating and conveying operation can be realized in conformity with the kind or the like of the sheet material.

Also, provision may be made of spacing adjusting mode changeover means provided with an automatic adjusting mode for automatically adjusting the spacing between the conveying rotatable member and the separating rotatable member by the spacing adjusting means in the sheet material separating and conveying operation, and a manual adjusting mode for inputting and setting the spacing between the conveying rotatable member and the separating rotatable member, and changing over the automatic adjusting mode and the manual adjusting mode.

In this construction, an appropriate separating and conveying state conforming to the kind or the like of the sheet material can be realized by changing over the spacing adjusting modes.

Also, provision may be made of reference value displaying means for displaying the adjusted value of the spacing between the conveying rotatable member and the separating rotatable member in the automatic adjusting mode when the mode is changed over to the manual adjusting mode.

In this construction, when the spacing between the conveying rotatable member and the separating rotatable member is inputted and set, it can be set with reference to the adjusted value in the automatic adjusting mode and therefore, how the spacing can be set on the basis of the separated and conveyed state in the automatic adjusting mode can be judged, and appropriate setting can be effected quickly.

Also, the sheet material feeding apparatus of the present invention is characterized by the provision of sheet material supporting portion moving means for moving a sheet material supporting portion to dispose sheet materials supported on the sheet material supporting portion at the predetermined feeding position.

In this construction, the sheet material supporting portion is moved, whereby even when a plurality of sheet materials are supported thereon, the sheet materials can be successively disposed at the predetermined feeding position and therefore, good separating and conveying performance can be obtained irrespective of the number of the sheet materials.

Also, provision may be made of sheet material detecting means for detecting the presence or absence of sheet materials at the predetermined feeding position, and design may be made such that when during the feeding of the sheet material, the sheet material does not arrive at the separating and conveying means, the sheet material supporting portion is moved to a position in which the sheet material detecting means comes to detect no sheet material, whereafter the sheet materials are again disposed at the predetermined feeding position and the sheet material supporting portion is moved to a position in which the sheet material detecting means detects a sheet material.

In this construction, as when the position of the sheet material supporting portion is inappropriate, the sheet material supporting portion can be moved and the sheet materials can be again disposed at the predetermined feeding position to thereby feed the sheet materials accurately.

Here, when the sheet material supporting portion is to be again moved after it has been moved to a position in which the sheet material detecting means comes to detect no sheet material, the sheet material supporting portion can be moved at a speed differing from that during the previous sheet feeding operation, i.e., faster or more slowly. By further changing the control conditions as described above, the cause of bad feeding can be avoided.

Also, the sheet material feeding apparatus of the present invention may have a manually inserting mode for feeding a manually inserted sheet material, and design may be made such that in the manually inserting mode, the sheet material supporting portion is moved so that the manually inserted sheet material may be disposed at the predetermined feeding position, and the feeding rotatable member, the conveying rotatable member and the separating rotatable member are rotated in the sheet material conveying direction at the same peripheral velocity.

By the sheet material supporting portion being thus moved so that the manually inserted sheet material may be disposed at the predetermined feeding position, feeding similar to that when the sheet materials are fed from the sheet material supporting portion becomes possible even when the sheet materials are manually inserted. Further, even when the feeding rotatable member, the conveying rotatable member and the separating rotatable member are rotated in the sheet material conveying direction at the same peripheral velocity, whereby the sheet material is folded in two, stable feeding becomes possible.

Also, design may be made such that in the manually inserting mode, the spacing between the conveying rotatable member and the separating rotatable member is set to the order of the minimum value of the thickness of the sheet material.

In this construction, feeding can be effected irrespective of the thickness of the manually inserted sheet material.

Also, design may be made such that in the manually inserting mode, the spacing between the conveying rotatable member and the separating rotatable member is made greater than that in the initial state after the sheet material has arrived at conveying means located downstream of the separating and conveying means with respect to the sheet material conveying direction.

In this construction, an unnecessary force is not applied to the sheet material by the separating and conveying means when the sheet material is conveyed by the downstream conveying means.

Also, design may be made such that in the manually inserting mode, at the start of the feeding, the sheet material is conveyed at a speed lower than the predetermined conveyance speed of the sheet material when the sheet materials supported on the sheet material supporting portion are fed, and is accelerated to the predetermined conveyance speed. In this construction, it never happens that a user who has manually inserted a sheet material is surprised at the speed at which the sheet material is conveyed and holds down the sheet material to thereby cause skew feeding, and stable feeding becomes possible.

Also, provision may be made of control condition setting means capable of setting the control conditions of the sheet material separating and conveying operation, and control condition storing means for storing the set substance by the control condition setting means.

In this construction, the control conditions can be finely set in conformity with the kind or the like of the sheet material. Also, the once set control conditions are stored by the control condition storing means, whereby thereafter, if the stored set substance is called out, the trouble of resetting it can be omitted, and an appropriate separating and conveying operation can be simply realized.

Also, design may be made such that in the sheet material separating and conveying operation based on predetermined control conditions, when the sheet material is to be again fed, the control conditions are changed on the basis of the set substance stored in the control condition storing means.

In this construction, when the sheet material is to be fed again, it can be fed with the setting changed to preset more appropriate control conditions.

Also, communication means may be provided between the sheet material feeding apparatus and an external apparatus, and the external apparatus may be provided with external control condition setting means for setting the control conditions of the sheet material separating and conveying operation through the communication means.

In this construction, even when abnormality occurs to the sheet material separating and conveying operation, the user can change the setting from the external apparatus and the higher efficiency of the work can be achieved.

Also, each of the conveying rotatable member and the separating rotatable member may comprise a plurality of rollers disposed in a comb-tooth-like form on the same shaft, and the rollers constituting the conveying rotatable member and the rollers constituting the separating rotatable member may be axially alternately disposed.

In this construction, the parallelism of the shafts of the conveying rotatable member and the separating rotatable member and the work of adjusting the spacing between the conveying rotatable member and the separating rotatable member can be simplified and therefore, the assembling property is improved.

Also, a sheet material processing apparatus having a sheet material feeding portion for feeding sheet materials, and a sheet material processing portion for processing the fed sheet materials may be provided with the sheet material feeding apparatus in the sheet material feeding portion.

In this construction, there can be provided a sheet material processing apparatus of high reliability. The predetermined processing for the sheet materials includes the processing of reading images on the sheet materials, and forming images on the sheet materials, but is not restricted thereto.

Also, there can be provided an image reading apparatus which is provided with an original feeding portion for feeding a sheet-like original, and an image reading portion for reading an image on the fed original, and in which if the sheet material feeding apparatus is provided in the original feeding portion, the original can be accurately fed to the image reading portion and image reading of high reliability is possible.

Also, design may be made such that the separating and conveying speed for the original is set independently of the reading speed in the image reading portion.

In this construction, a separating and conveying speed conforming to the kind or the like of the original can be set irrespective of the reading speed in the image reading portion, and more accurate separation and conveyance become possible.

DESCRIPTION OF THE PREFERRED EMBODIMENTS (First Embodiment)

Figure 1A:
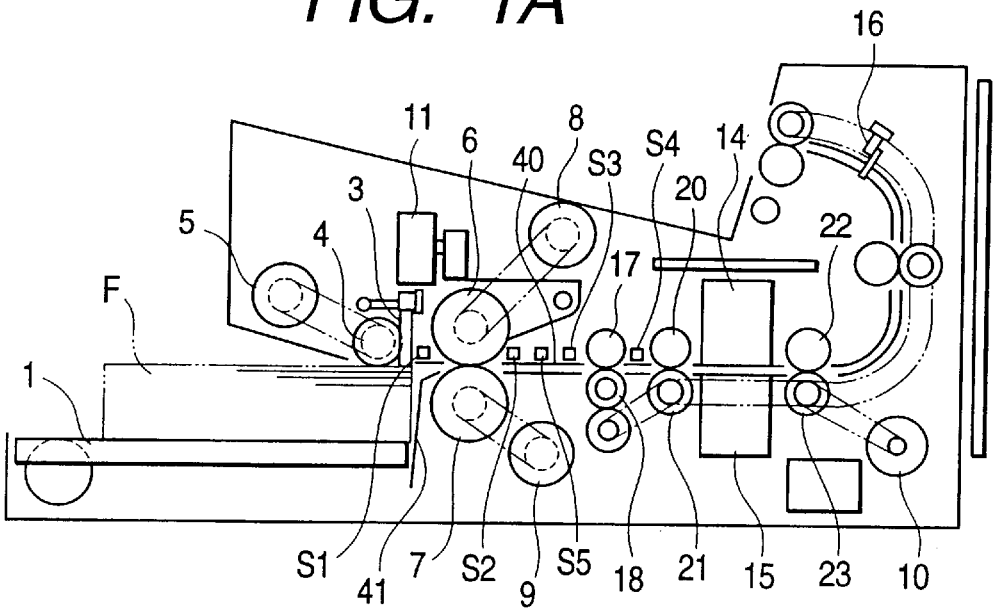
FIG. 1A schematically shows the construction of an image reading apparatus according to a first embodiment of the present invention, and FIG. 1B schematically shows the construction of the essential portions of the image reading apparatus.
Figure 1B:
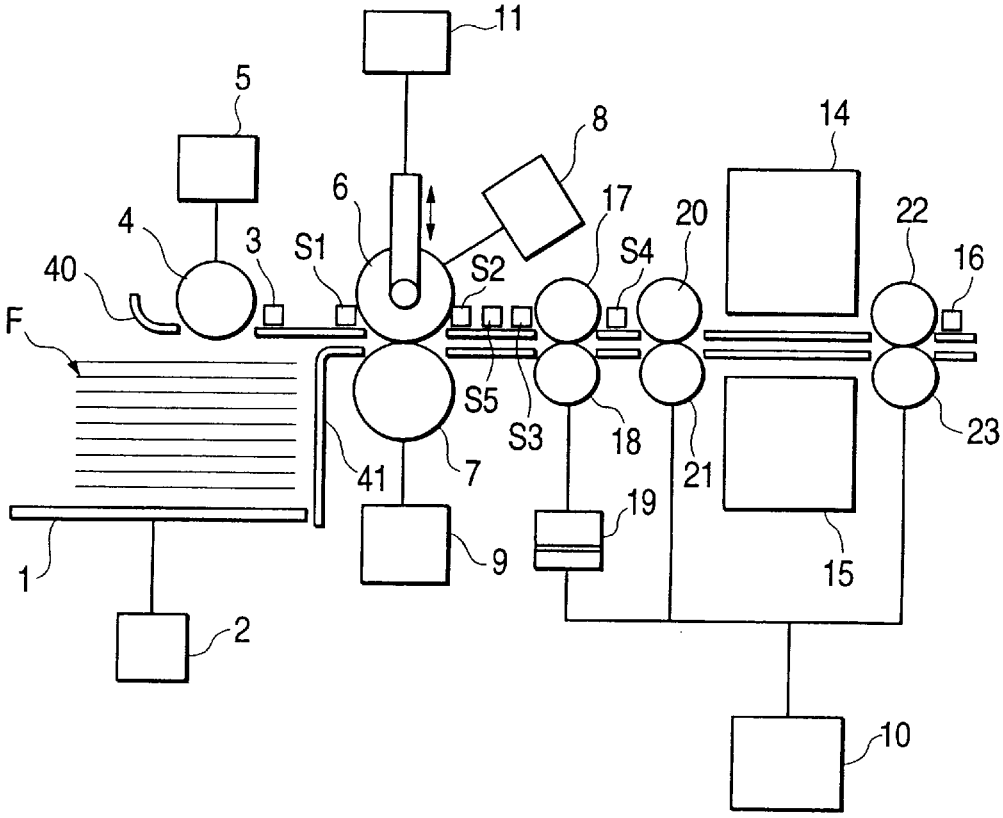

FIG. 1A schematically shows the construction of an image reading apparatus according to a first embodiment of the present invention, and FIG. 1B schematically shows the construction of the essential portions of the image reading apparatus.

The reference numeral 1 designates an original supporting table as a sheet material supporting portion, the reference numeral 2 denotes an original supporting table driving motor as sheet material supporting portion moving means, and the reference numeral 3 designates an original detecting sensor as sheet material detecting means.

The reference numeral 4 denotes a sheet feeding roller as a feeding rotatable member, and the reference numeral 5 designates a sheet feeding motor as driving means for directly driving the sheet feeding roller 4.

The reference numeral 6 denotes a feeding roller as a conveying rotatable member, the reference numeral 7 designates a separating roller as a separating rotatable member, the reference numeral 8 denotes a feeding motor as driving means for directly driving the feeding roller 6, and the reference numeral 9 designates a separating motor as driving means for directly driving the separating roller 7. In the present embodiment, the feeding roller 6 and the separating roller 7 together constitute separating and conveying means.

The reference numeral 10 denotes a conveying motor capable of conveying an original after separated and conveyed from an original reading position to a sheet discharging position and at the same time, changing the original reading speed and the speed by resolution or the like.

The reference numeral 11 designates a sheet thickness adjusting motor as spacing adjusting means capable of adjusting the spacing between the feeding roller 6 and the separating roller 7 and automatically effecting the separation and conveyance of sheets in a precise state.

The reference numerals 14 and 15 denote reading sensors (a sheet material processing portion and an image reading portion) for reading the front and back surfaces, respectively, of an original, and changing the scanning spacing on the basis of the original reading speed and resolution. Also, as regards the operations of the original reading sensors, the operations of reading timing synchronized with and reading timing non-synchronized with the sheet feeding motor, the feeding motor and the separating motor can be selected.

The reference numeral 16 designates a sheet discharge sensor for detecting that an original has passed a reading portion and has been discharged to a sheet discharging portion.

The reference numerals 17 and 18 denote registration rollers for temporarily blocking the movement of the leading end of the original, and correcting the skew feeding of the original.

The reference numeral 19 designates a registration clutch for switching the connection or disconnection of the driving of the conveying motor to the registration rollers.

The reference numerals 20, 21, 22 and 23 denote original conveying rollers for conveying the original F.

The reference numeral 40 designates an upper guide plate, and the reference numeral 41 denotes a lower guide plate, and the original F is conveyed between these two guide plates.

The reference character S1 designates a pre-sheet feeding sensor, the reference character S2 denotes a post-sheet feeding sensor, the reference character S3 designates a pre-registration sensor, the reference character S4 denotes a post-registration sensor, and the reference character S5 designates a double feeding detecting sensor (double feeding detecting means), and on the basis of the outputs of the respective sensors, a control portion, not shown, effects the control of the synchronized driving and non-synchronized driving of the motors of the respective portions.

Figure 2:
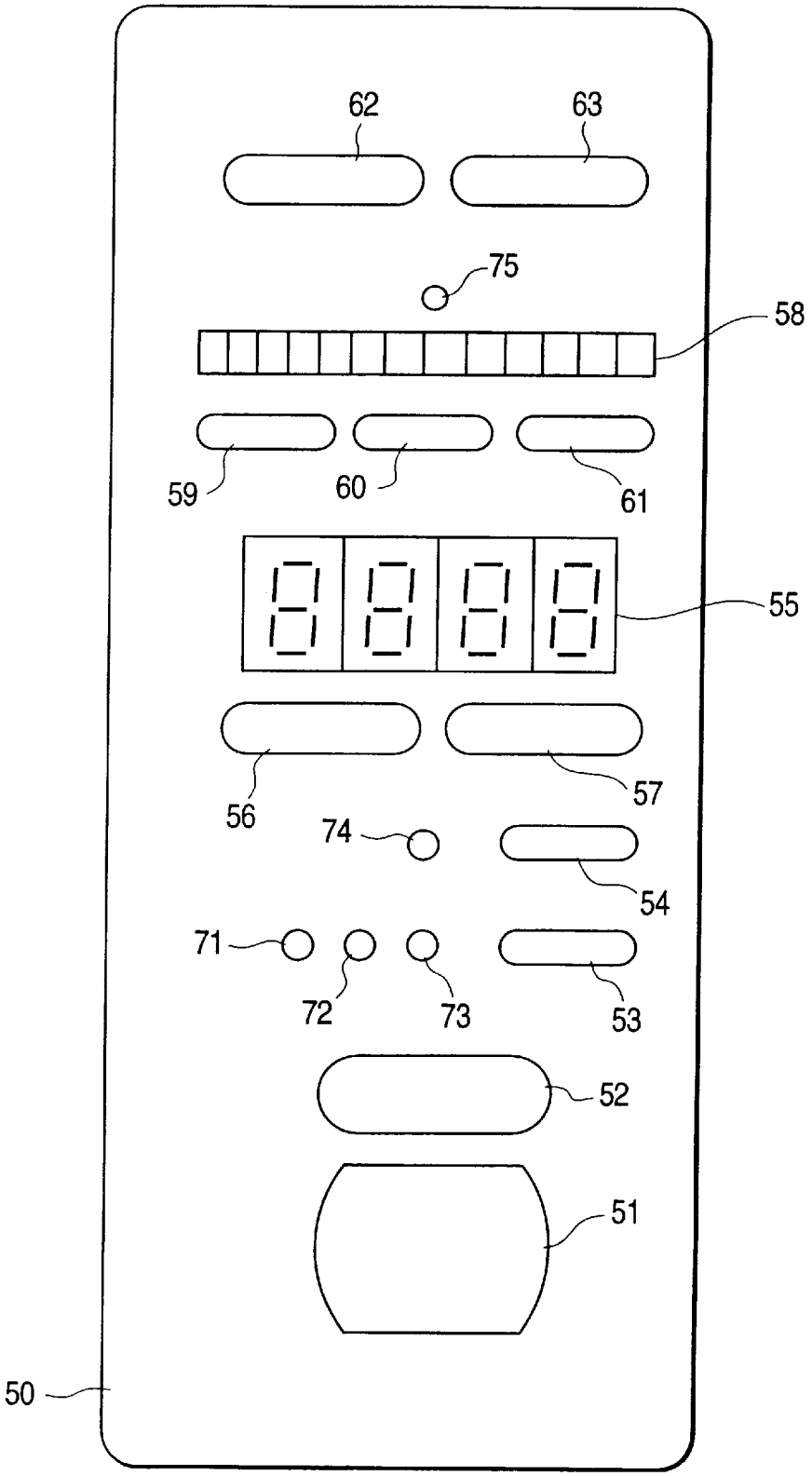
FIG. 2 shows an example of the construction of the displaying portion of the image reading apparatus according to the first embodiment of the present invention.

FIG. 2 shows an embodiment of an operating portion using the present invention.

The reference numeral designates the operating portion of the present embodiment, and the reference numeral 51 denotes a start switch (driving method switching means, mode changeover means) used for the starting of original reading with originals carried on the original supporting table 1, or the starting of counting, the execution of the inputting of a variable, etc.

The reference numeral 52 denotes a stop switch used for the stoppage of original reading, the clearing of count, and the cancellation or clearing of the inputting of the variable.

The reference numeral 53 designates a sheet thickness adjusting mode selecting switch (spacing adjusting mode changeover means) for changing over the sheet thickness controlling system to automatic, manual and manual insertion. It is also possible to increase the modes in conformity with the kinds of the sheets.

The reference numeral 54 denotes a switch for changing over the ON/OFF of double feeding detection.

The reference numeral 55 designates a sheet number counter used for the confirmation of the number of read and conveyed originals, the setting of the number of read sheets, the setting of the number of double-fed sheets, the setting and display of the driving rotational speeds of the motors of the respective portions, the display of the operative state and error of the apparatus, etc.

The reference numerals 56 and 57 denote switches (control condition setting means) used to set the number of sheets for the sheet number counter, and change the various set numerical values.

The reference numeral 58 designates a display of original reading density used as the display of an original reading temperature and the display during the manual adjustment of sheet thicknesses.

The reference numerals 59, 60 and 61 denote switches for selecting the density change and AE of originals, and used to input the data of sheet thicknesses during the manual adjustment of sheet thicknesses.

The reference numerals 62 and 63 designate memory switches capable of storing said setting in a memory as control condition storing means and also used so as to be capable of setting a plurality of sheet feeding conveying modes and coping with them individually.

The reference numerals 71, 72 and 73 denote LED's for effecting the selection and display of the sheet thickness adjusting modes, and the LED 71 is turned on and displays during the automatic sheet thickness adjusting mode, the LED 72 is turned on and displays during the manual adjusting mode, and the LED 73 is turned on an displays during the manual insertion mode.

The reference numeral 74 designates an LED for displaying the ON/OFF of double feeding detection, and this LED is turned on when double feeding detection is effective.

The reference numeral 75 denotes the display of ON/OFF of automatic density adjustment.

The operation of the present invention is as follows.

First, a plurality of originals F are carried on the original supporting table 1. Here, a signal from the start switch 51 of the operating portion 50 is sent to a control circuit, not shown, which in turn sends an elevating signal to the original supporting table motor 2, and the original supporting table 1 is elevated to thereby elevate the originals F to a sheet feeding position.

When the elevated originals are detected by the original detecting sensor 3, the sheet feeding motor 5 is driven in a conveying direction at a set speed to thereby rotate the sheet feeding roller 4.

The sheet thickness adjusting motor 11 is returned to a position for most closing the spacing between the feeding roller 6 and the separating roller 7 (a narrow spacing).

By the rotative driving of the sheet feeding roller 4, the uppermost one F1 of the originals F is carried to the separating and conveying portion, where it is detected by the pre-sheet feeding sensor S1. When the pre-sheet feeding sensor S1 detects the original, the separating motor 9 is driven and the separating roller 7 is rotated at a low speed in a direction opposite to the conveying direction. The separating motor 9 may be driven before the pre-sheet feeding sensor S1 detects the original.

For a prescribed time or the time of a prescribed pulse number after the original has been detected by the pre-sheet feeding sensor S1, the original F1 is conveyed and at the timing whereat the leading end of the original F1 strikes against the separating and feeding portion, the feeding motor 8 is driven and the feeding roller 6 begins to rotate at a predetermined speed and at the same time, the sheet thickness adjusting motor starts to rotate to widen (enlarge) the spacing between the feeding roller 6 and the separating roller 7.

When the pre-sheet feeding sensor S1 has detected the original, the feeding motor 8 is driven at a low speed, and when the leading end of the original strikes against the separating and feeding portion, the feeding motor 8 is driven at a high speed to rotate the feeding roller at a predetermined speed, whereby even if the lending end of the original is more or less bent, the original can be smoothly separated and fed.

Then, the spacing between the feeding roller 6 and the separating roller 7 is widened, whereby the original F1 begins to pass between these two rollers.

The original F1 is detected by the post-sheet feeding sensor S2 at a point of time whereat it has passed the separating and conveying portion. By a signal from this post-sheet feeding sensor S2, the sheet thickness adjusting motor 11 adjusts the opening and closing amount of the feeding roller 6 and the separating roller 7, and thereafter is stopped.

Figure 3:
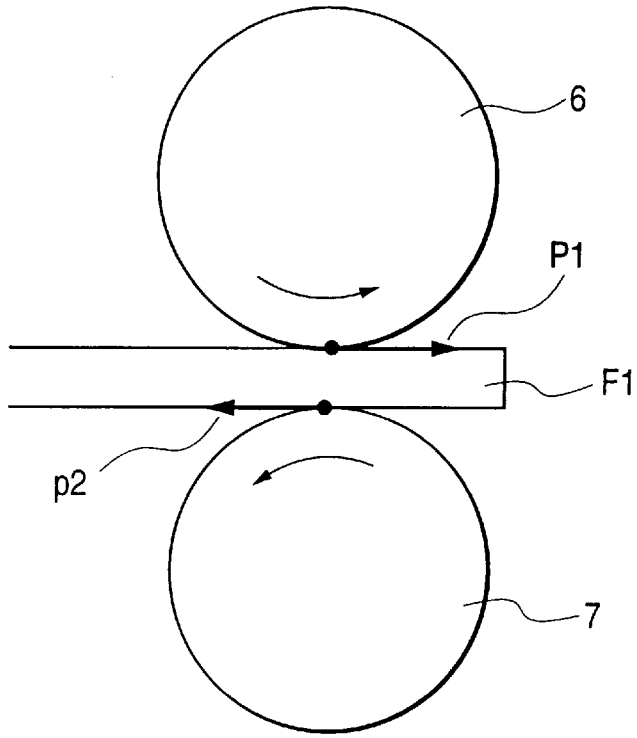
FIG. 3 shows the action of a force to an original in the image reading apparatus according to the first embodiment of the present invention.

As shown in FIG. 3, the original F1 has applied thereto a static frictional force P1 in the conveying direction at the feeding roller 6 side, and has applied thereto a dynamic frictional force p2 in a direction opposite to the conveying direction at the separating roller 7 side.

Figure 4:
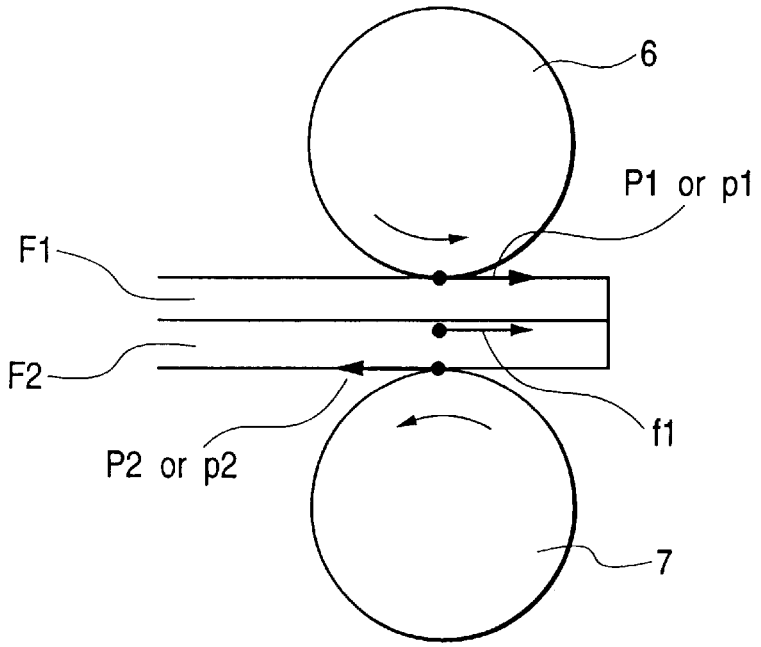
FIG. 4 shows the action of a force to an original in the image reading apparatus according to the first embodiment of the present invention.

Therefore, even if the second or subsequent original F2 is inserted in a manner as shown in FIG. 4, double feed will not occur unless static friction f1 greater than the dynamic frictional force p2 from the separating roller 7 occurs between the originals F1 and F2.

Figure 5A:
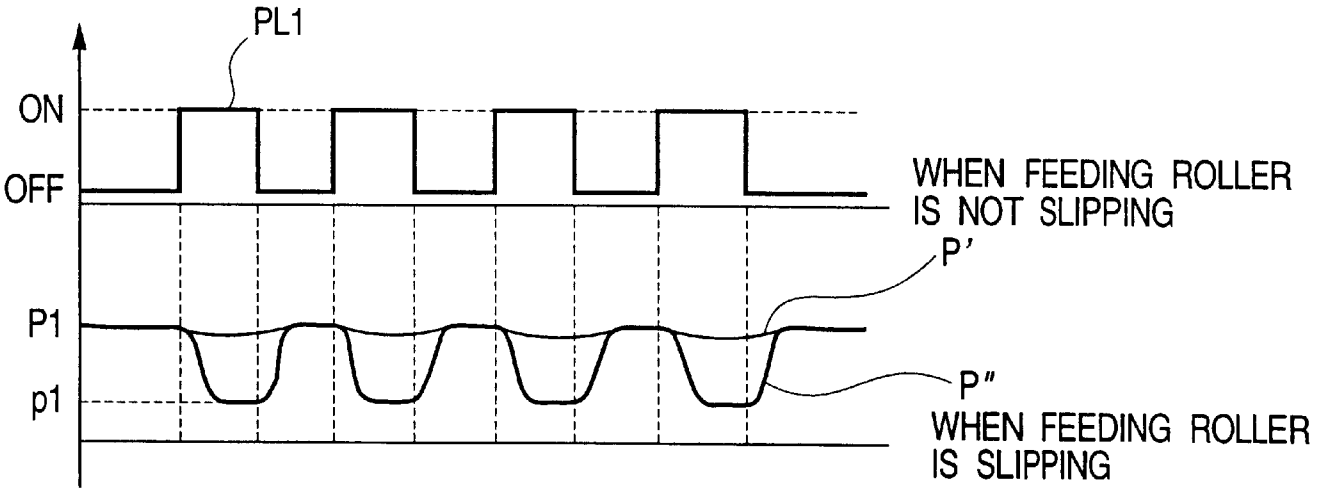
FIGS. 5A and 5B show a pulse signal waveform applied to the pulse motor of the image reading apparatus according to the first embodiment of the present invention and a variation in the force acting on the original.
Figure 5B:
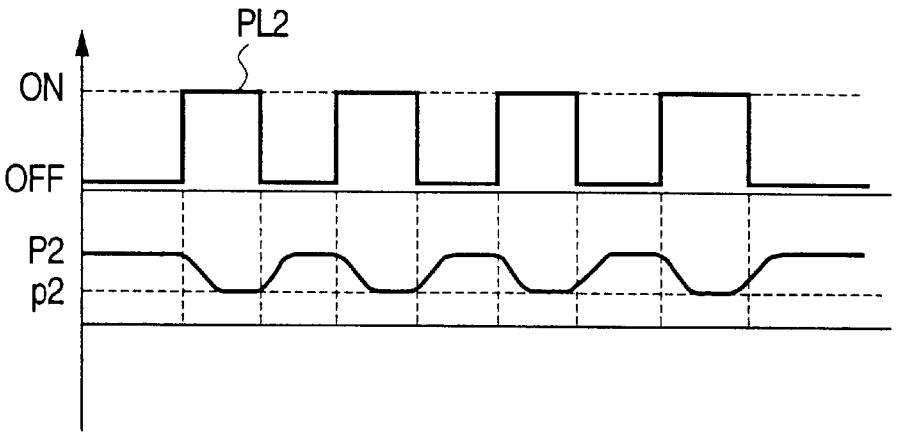

Next, when the feeding motor 8 and the separating motor 9 utilize a step motor or the like capable of step-feeding to drive with the phases of driving pulses synchronized with each other, the force applied to the original F in the separating and conveying portion varies between the dynamic frictional forces pl, p2 and the static frictional forces P1, P2, as shown in FIGS. 5A and 5B.

In FIG. 5, PL1 designates a pulse signal waveform applied to the feeding motor 8, PL2 denotes a pulse signal waveform applied to the separating motor 9, P1 and p1 designate a static frictional force and a dynamic frictional force, respectively, from the feeding roller 6, and P2 and p2 denote a static frictional force and a dynamic frictional force, respectively, from the separating roller 7. P' indicates the static frictional force when the feeding roller 6 is not slipping relative to the original, and P" indicates the static frictional force when the feeding roller 6 is slipping relative to the original.

Generally, the static friction is greater than the dynamic friction and can obtain a force greater than the dynamic frictional force p2 during constant rotation.

In this synchronous driving method, the separating and conveying time for the original F becomes long and this results in a reduction in sheet feeding efficiency, but even when the coefficient of dynamic friction between the originals is great, double feed is decreased.

So, when the feeding motor 8 and the separating motor 9 are to be driven, when originals having a small coefficient of friction therebetween are to be conveyed and read, the conventional non-synchronous driving is adopted, and when the coefficient of friction between originals is great, changeover is effected to non-synchronism, whereby for various originals, sheet feeding and conveyance can be effected without causing double feed. Also, it is preferable that the sheet feeding motor 5 and the feeding motor 8 be driven in synchronism with each other, whereby the originals can be fed smoothly.

Next, when the original F1 fed through the separating and conveying portion is detected by the pre-registration detecting sensor S3, the separating motor 9 is once stopped and only the feeding motor 8 is driven. Thereby, the temporary slippage between the feeding roller 8 and the original F1 which rarely occurs due to an increase or decrease in the above-described dynamic friction becomes null and the amount of feed of the original F1 from the position detected by the pre-registration detecting sensor S3 becomes accurate.

After it has a passed this pre-registration detecting sensor S3, the original F1 strikes against the registration rollers 17 and 18 after a prescribed pulse or a prescribed time and flexure is formed in the original F1, whereby the leading end portion of the original F1 follows the registration rollers 17 and 18, whereafter the registration clutch 19 becomes ON, whereby the skew feeding of the original F1 can be corrected.

The time or pulse from after the original has passed the pre-registration detecting sensor S3 until the registration clutch 19 becomes ON can be changed by the thickness or quality of the original F1.

After the post-registration sensor S4 detects the original which has passed between the registration rollers, the feeding motor 8 stops driving and the separating motor 7 resumes driving.

From after a prescribed pulse after the post-registration sensor S4 has detected the original F1, the original reading sensors 14 and 15 start their reading operations and at the same time, the original is controlled by the control circuit until it is detected by the sheet discharge sensor 16 after the prescribed pulse.

Next, when the originals F are to be continuously fed and conveyed, the following procedure is gone through.

With the feeding motor 8 stopped and the separating motor driven after the trailing end of the first original F1 has passed the post-sheet feeding sensor S2, the sheet thickness adjusting motor 11 is driven in a direction to close the space between the feeding roller 6 and the separating roller 7.

Figure 6A:
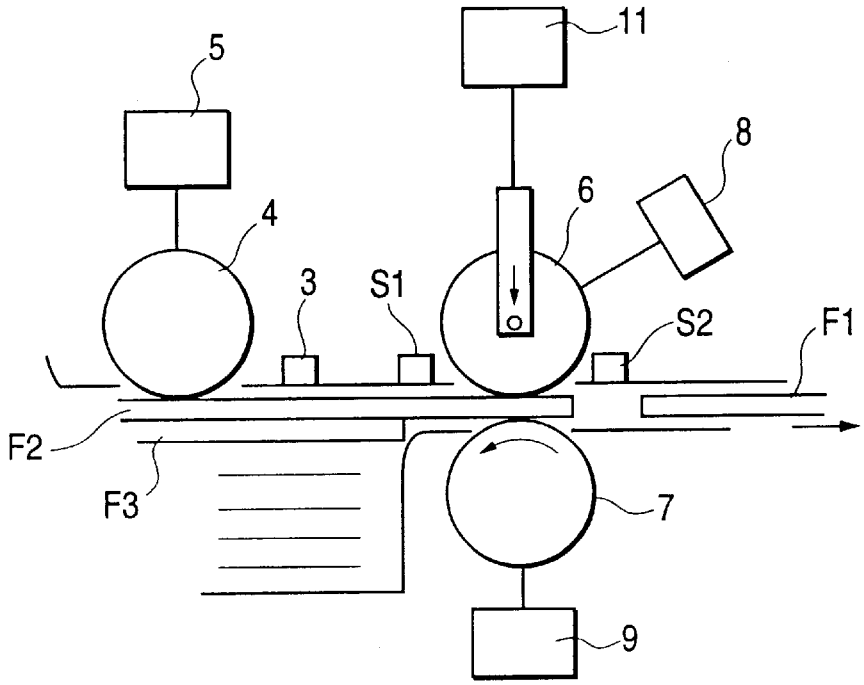
FIGS. 6A and 6B show the operations of the respective portions of a separating and conveying portion in the continuous feeding in the image reading apparatus according to the first embodiment of the present invention.
Figure 6B:
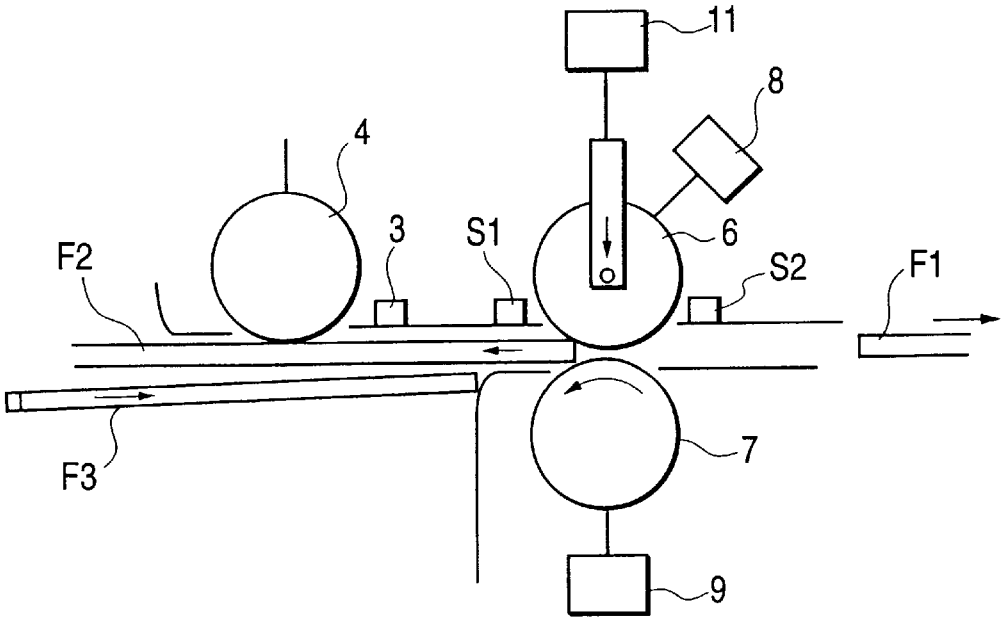

Thereby, the original F2 which has entered the separating and conveying portion after the preceding original F1 as shown in FIG. 6 is once returned to the front of the separating and conveying portion as soon as the space between the rollers is closed.

Thereafter, the ordinary separating and conveying operation is resumed, whereby the separating and conveying operation for the second and subsequent originals can be performed in the same manner as that for the first original.

Figure 7A:
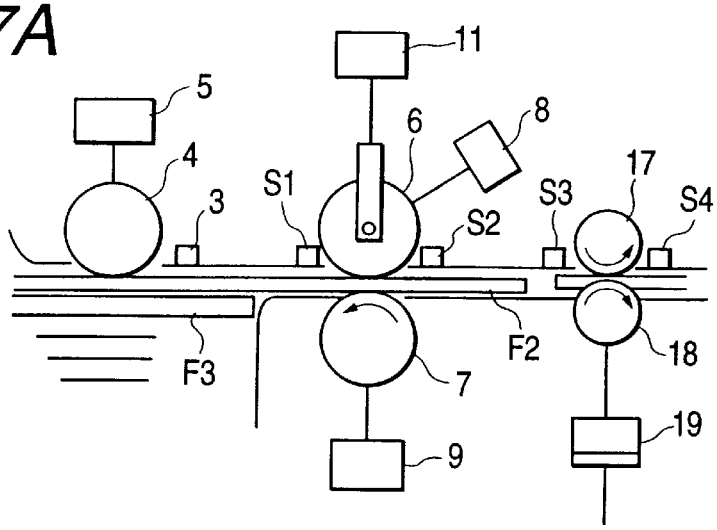
FIGS. 7A, 7B and 7C show the operation of the separating and conveying portion in the double feeding state of the image reading apparatus according to the first embodiment of the present invention.
Figure 7B:
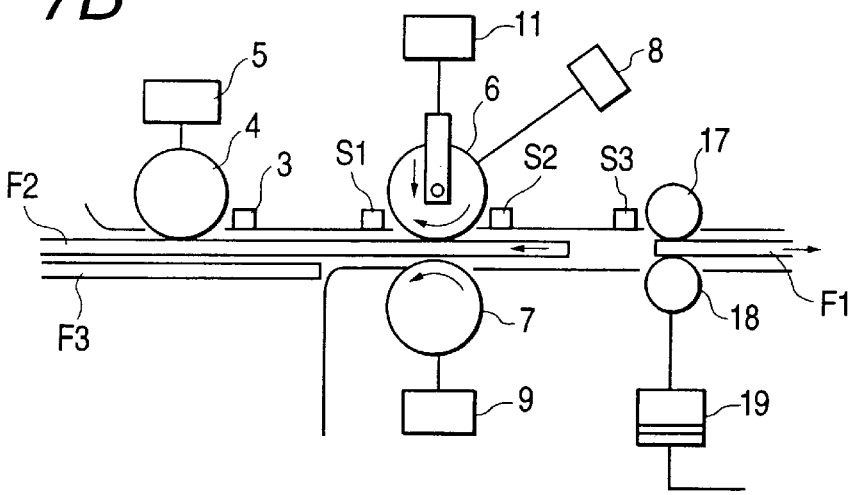
Figure 7C:
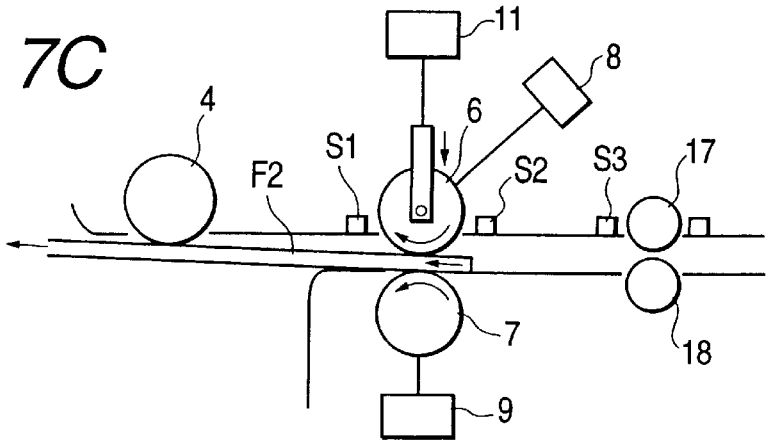

When as shown in FIG. 7, the next original F2 has come to the post-sheet feeding sensor S2 by a sort of double feeding, the feeding motor 8 is driven in a direction opposite to the conveying direction at a point of time whereat the pre-registration sensor S3 has detected the trailing end of the original F1.

At the same time, the registration clutch 19 becomes OFF at a position in which some of the trailing end remains after a prescribed pulse after the trailing end has been detected so that the second and subsequent originals F2 may not be fed by the registration rollers 17 and 18.

After the feeding motor 8 has begun its reverse rotation, the sheet thickness adjusting motor 11 starts driving in a direction in which the separating and conveying portion is closed, whereby the original F2 is returned to the front of the separating and conveying portion.

The feeding motor 8 is reversely driven, and is driven by a prescribed pulse after the post-sheet feeding sensor S2 has detected the leading end of the original F2, and resumes its ordinary separating and conveying operation after the original F2 has been returned to the front of the separating and conveying portion.

Thereby, even when the original F2 has come together to the post-sheet feeding sensor S2 and subsequent sensors, it becomes possible to once return the original F2 from the separating and feeding portion to the front of the separating and conveying portion, and the separating and conveying operation for the second and subsequent originals becomes possible.

As described above, design is made such that the sheet feeding roller, the conveying roller and the separating roller are driven independently of one another and the driving method can be selected and set in conformity with the kinds of the originals, whereby reliable sheet conveyance which could not be realized by the conventional apparatuses can be made possible.

(Second Embodiment)

While in the first embodiment, the adjusting method for the sheet thickness adjusting motor 11 is uniform, the following means is also effective.

First, the original F1 is detected by the pre-sheet feeding sensor S1 by the rotative driving of the sheet feeding roller 4, and the original F1 is driven to the separating and conveying portion by an amount corresponding to a prescribed pulse, whereafter the feeding motor 8 is driven and at the same time, the sheet thickness adjusting motor 11 is driven.

However, when the opening amount is small and the opening is narrow, double feed occurs simply by thin sheets passing the separating and conveying portion and this portion being opened slightly too much.

In addition, on the sheet feeding roller 4 and the feeding roller 6, slip or the like occurs due to the fluctuation of the friction irregularly occurring between the roller portion and the original portion, and the separating and conveying portion is opened two much and double feed occurs.

Therefore, it is necessary to slow down the operating speed of the sheet thickness adjusting motor 11.

To the contrary, when thick originals are used, the sheet thickness adjusting motor 11 need be much driven until the originals are separated and conveyed, and the separating and conveying speed is reduced.

Figure 8A:
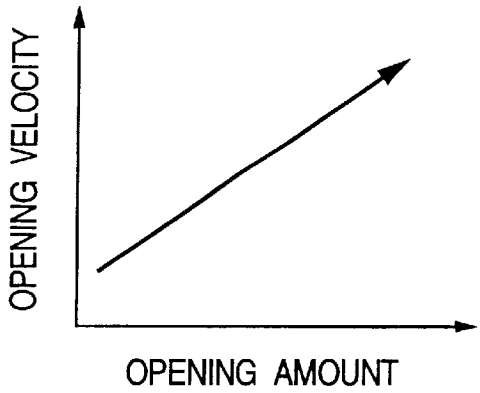
FIGS. 8A, 8B and 8C show the relation between the opening amount and the opening velocity when the opening velocity relative to the opening amount of the separating and conveying portion of the image reading apparatus according to the first embodiment of the present invention is changed.

Here, as shown in FIG. 8A, the opening speed by the sheet thickness adjusting motor 11 is varied by the opening amount of the separating and conveying portion, whereby the above-noted problem can be solved.

Control is effected so that when the spacing between the feeding roller 6 and the separating roller 7 at the early stage of driving is narrow, the rotational speed of the sheet thickness adjusting motor 11 may be low and the opening velocity may become higher as the opening becomes wider.

The opening velocity for this opening amount can be realized without slowing down the general separating and conveying speed, by adjusting the velocity depending on the quantity of originals differing in kind or thickness.

Figure 8B:
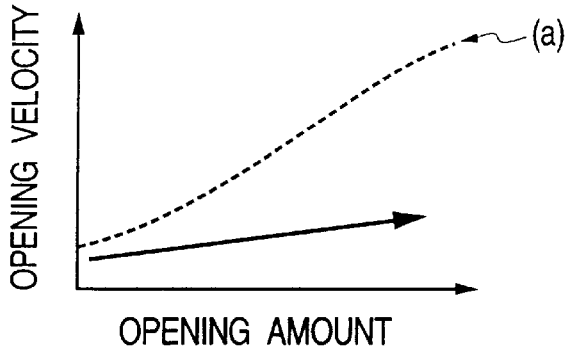

FIG. 8B shows the setting when there are many thin originals, and the opening velocity in a state in which the opening amount is small is set slowly, and this is directed to accurate separation and conveyance.

Figure 8C:
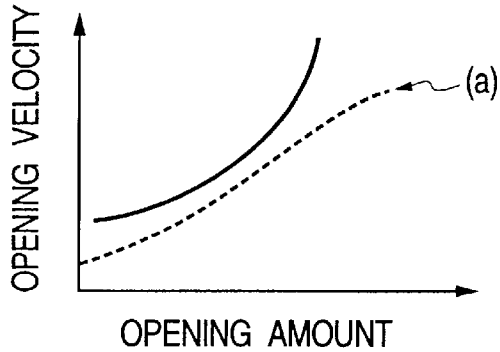

FIG. 8C shows an example of the setting when there are many thick originals, and even from a state in which the opening amount is small, the opening velocity is set to a rather high level, and this is directed to preventing the separating and conveying speed from being reduced when there are many thick originals.

(Third Embodiment)

Figure 9:
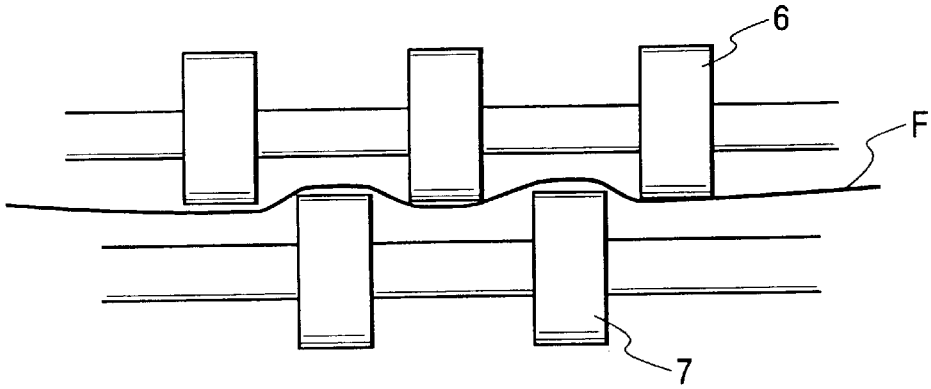
FIG. 9 shows the flexure of a thin original in the separating and conveying portion.

When as shown in FIG. 9, the original F is a thin original and when it is separated and conveyed between the feeding roller 6 and the separating roller 7, the original F is conveyed in a waving state between the comb-tooth-like rollers. In this embodiment, the feeding roller 6 and the separating roller 7 have a plurality of axially spaced apart rollers, and the upper and lower rollers are disposed so as not to be opposed to each other and in an overlapping state.

Therefore, the original F may be damaged or contaminated by waving.

To avoid this, design is made such that after the post-sheet feeding sensor S2 has detected the original F, the sheet thickness adjusting motor 11 is further moved by an amount corresponding to a prescribed pulse to thereby achieve correction.

Figure 10:
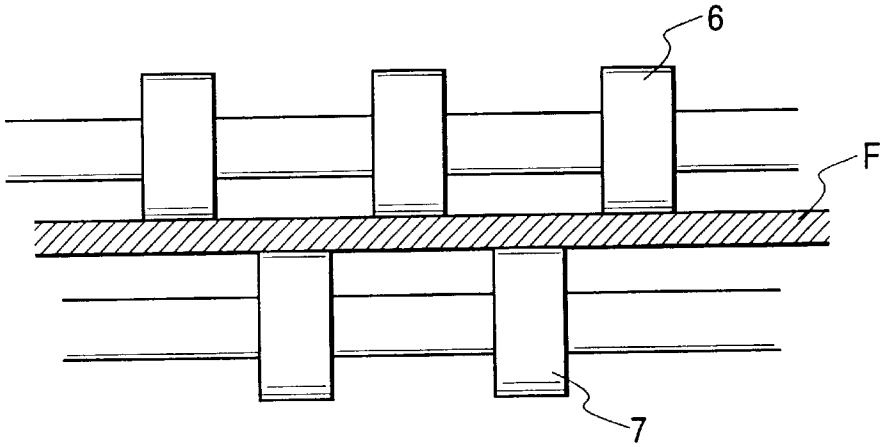
FIG. 10 shows the state of a thick original in the separating and conveying portion.

At the same time, when as shown in FIG. 10, the original F is a thick and hard original, the original is very little deformed into a wavy shape and not only correction need not be effected, but also the stoppage of driving may sometimes be delayed because the driving speed of the sheet thickness adjusting motor 11 is high by the second embodiment.

Figure 11:
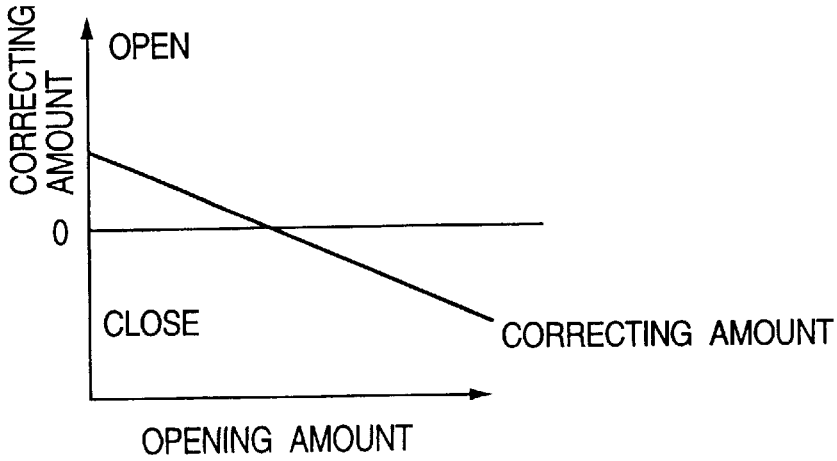
FIG. 11 shows the relation between the opening amount of the separating and conveying portion and the correcting amount of the opening amount.

Thus, as shown in FIG. 11, correction is effected by the driving amount of the sheet thickness adjusting motor 11 when the post-sheet feeding sensor S2 has detected the original, whereby reasonable and precise automatic sheet thickness adjustment becomes possible for the original.

(Fourth Embodiment)

In the prior-art apparatus as previously described, the sheet feeding roller, the feeding roller and the separating roller are primarily constructed by the use of gears or the like and therefore it is impossible to change the conditions of separation and conveyance.

Therefore, even if bad conveyance or double feed or the like can be detected, separation and conveyance are effected under the same conditions and thus, bad conveyance or double feed or the like occurs again and there is no opportunity for effecting re-separation and re-conveyance.

However, according to the apparatus using the present invention, the sheet feeding roller, the feeding roller and the separating roller can be uniquely driven, and coupled with the aforedescribed automatization of sheet thickness adjustment, more effective re-separation and re-conveyance become possible.

Figure 12A:
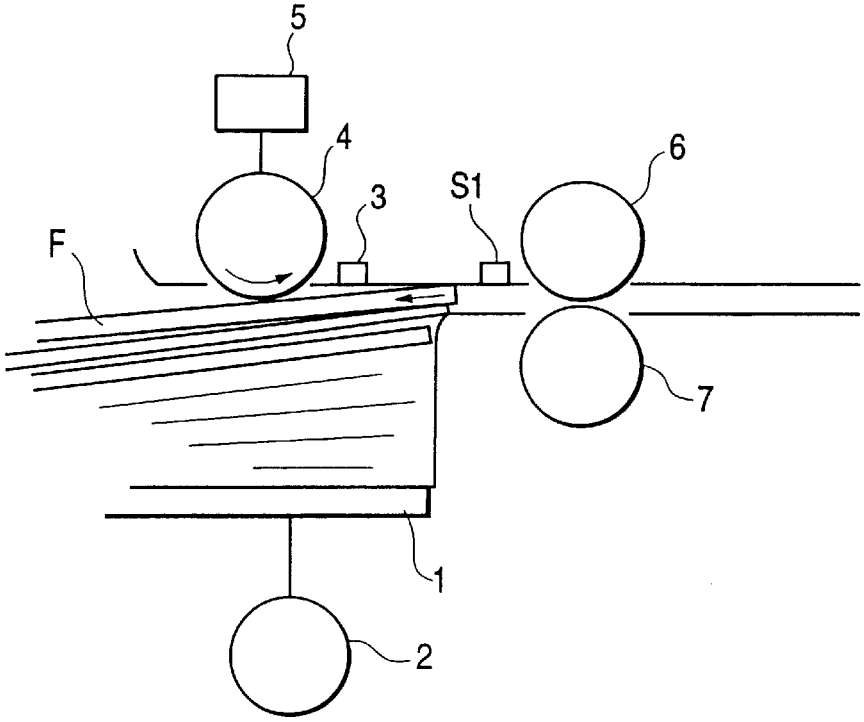
FIG. 12A shows a state in which jam has occurred near a sheet feeding portion.
Figure 12B:
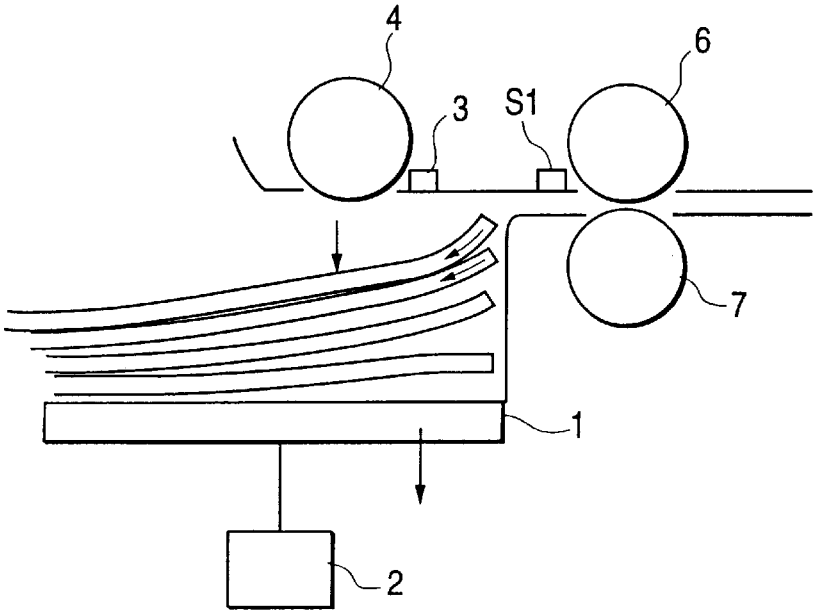
FIG. 12B shows a state in which an original supporting table has been lowered to recover from the jam.

First, the sheet feeding roller 4 is driven and when by a prescribed amount of conveyance, the original does not arrive at the pre-sheet feeding sensor S1 as shown in FIG. 12, the driving of the sheet feeding roller 4 is stopped and the original supporting table 1 is lowered and the original detecting sensor 3 is turned off.

Thereafter, the original supporting table 1 is slowly moved up again and after the original detecting sensor 3 has again detected the original F, the driving of the sheet feeding roller 4 is effected again.

This is very effective when the original supporting table is too much moved up by some cause or other and the original is pushed against the upper guide plate 30 or when a plurality of originals have come into the separating and conveying portion in a wedge-like manner.

Next, from the pre-sheet feeding sensor S1, the sheet thickness adjusting motor 11 and the feeding motor 8 are driven for a prescribed amount of conveyance.

In this case, the original cannot be detected by the post-sheet feeding sensor S2 even if the opening amount of the separating and conveying portion becomes maximum by the sheet thickness adjusting motor 11, the opening is narrowed down by the sheet thickness adjusting motor 11 until the opening amount becomes minimum while the feeding motor 8 is rotated reversely, and the feeding motor 8 is again driven in the forward direction to thereby resume separation and conveyance.

In this case, the driving speeds of the sheet thickness adjusting motor 11, the sheet feeding motor 5, the feeding motor 8 and the separating motor 9 are changed to thereby separate and convey the original under a condition differing from the initial condition, whereby precise separation and conveyance become possible.

Also, as regards the setting of each motor during re-separation and re-conveyance, it is also effective to slow down the speeds of the motors uniformly, but design is made such that the condition during re-separation can be set from the operating portion or the like, whereby it becomes possible to fit the condition to the condition of originals used by a user.

Next, when the original has passed the post-sheet feeding sensor S2 and the double feed detecting sensor S5 between it and the pre-registration sensor S3 has detected double feed, several methods are conceivable.

First, the feeding motor 8 and the sheet feeding motor 5 are stopped on the spot, and the sheet thickness adjusting motor 11 is driven so that the opening amount may become smaller while the separating motor 9 continues to be driven.

Then, the frictional force between the double-fed original F2 and the separating roller overcomes the frictional force between the originals, and the original F2 is fed in a direction opposite to the conveying direction. Thereby, double feed can be avoided.

Also, when the opening amount is restored to its original position by the sheet thickness adjusting motor 11 and separation and conveyance are to be effected again after both of the feeding roller and the sheet feeding motor are driven in the reverse direction and both of the originals F1 and F2 become undetectable from the post-sheet feeding sensor S2, the driving of the separating motor 9 and the feeding motor 8 is set so that synchronism may be taken by step feeding, whereby the recurrence of double feed can be prevented.

As described above, by providing the function of effecting re-separation and re-conveyance under a condition differing from the initial condition when double feed or bad conveyance has occurred, the automatization of the work and improved efficiency can be brought about.

(Fifth Embodiment)

In the present invention, sheet thicknesses are automatically corrected by the sheet thickness adjusting motor, but when the kinds of originals are limited, manual setting is also effective.

When manual setting is to be done, the sheet thickness adjusting mode selecting switch 53 of the operating portion 50 is depressed to thereby select the manual adjusting mode.

When this adjusting state is entered, the display portion 58 used for density display becomes turned on and off to thereby inform that the manual adjusting input mode has been brought about.

When in this state, the start switch 51 is depressed, the sheet thickness adjusting motor 11 is moved to a set and manually adjusted position, and the sheet feeding, separating and conveying operation is started.

Also, the method of driving the sheet feeding, conveying and separating motors when the manual adjusting mode has been entered can be selected so as to differ from that in the automatic sheet thickness adjusting state. The method is also changed when re-separation and re-conveyance are to be effected.

The changing of the sheet thickness adjusted value is done by operating the switches 59, 60 and 61.

By depressing the switch 60, the changing of the adjusted value becomes possible, and in this state, the switches 59 and 61 are operated to thereby effect the changing of the setting of the sheet thickness.

When the switch 60 is again depressed at a point of time whereat the changing of the setting has been terminated, the setting data is decided and a value set in the next separating and conveying operation becomes effective.

Also, when with this manual setting mode entered, the originals F are disposed on the original supporting table 1 and the start switch 51 is operated, separation and conveyance are effected by ordinary automatic sheet thickness adjustment, and the sheet thickness adjusted value at this time is displayed on the display portion (reference value displaying means) 58.

The display on the display portion 58 may also be done by changing the turn-on-and-off timing, or it is also effective to change the display color.

The user can quickly set a precise sheet thickness with this display as a rough index.

Thereby, when originals of the same kind are to be separated and conveyed, a fixed value can be used to realize reliable separation and conveyance though conditionally.

At the same time, by using the automatic sheet thickness adjusting function as an index, a proper sheet thickness adjusted value can be inputted quickly.

(Sixth Embodiment)

While in the above-described embodiment, description has been made of means for automatically feeding a plurality of originals, it is also possible to manually feed originals one by one.

The sheet thickness adjusting mode selecting switch 53 of the operating portion 50 is operated to thereby select the manual insertion mode.

Figure 13:
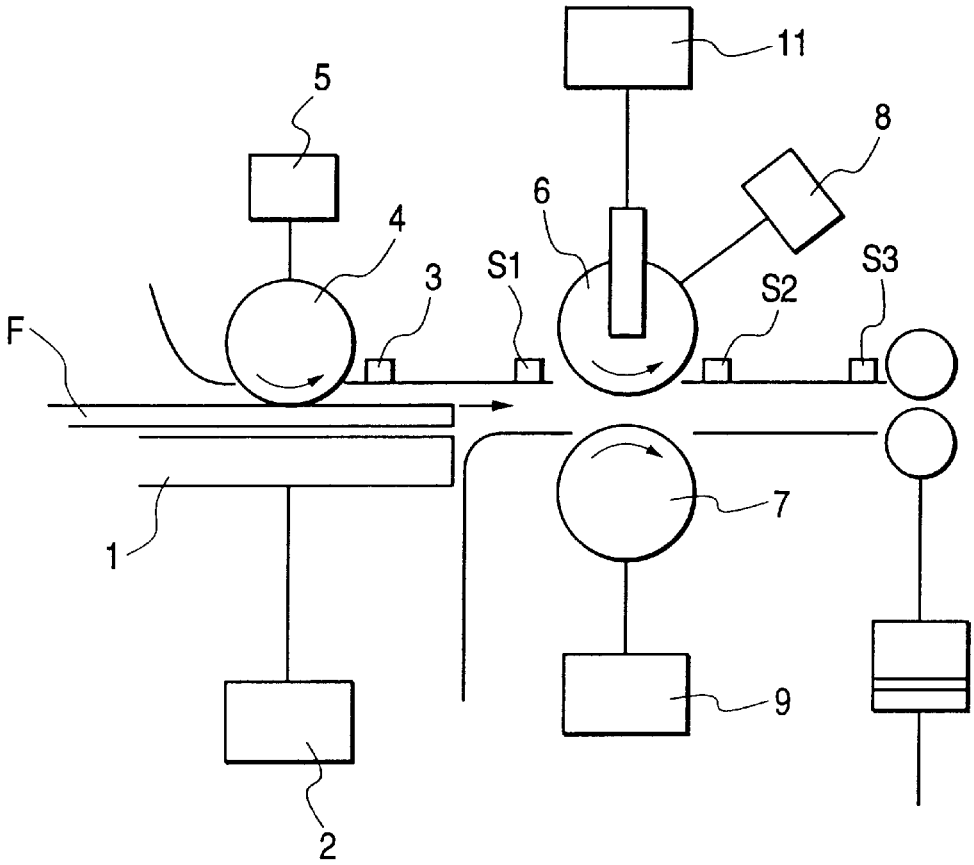
FIG. 13 shows the operation of the separating and conveying portion during manual insertion.

When this mode is selected, the original supporting table 1 is moved up to its uppermost position as shown in FIG. 13. When at this time, an original F1 is inserted onto the original supporting table 1, the original detecting sensor 3 detects the manually inserted original and the sheet feeding motor starts driving.

Figure 14:
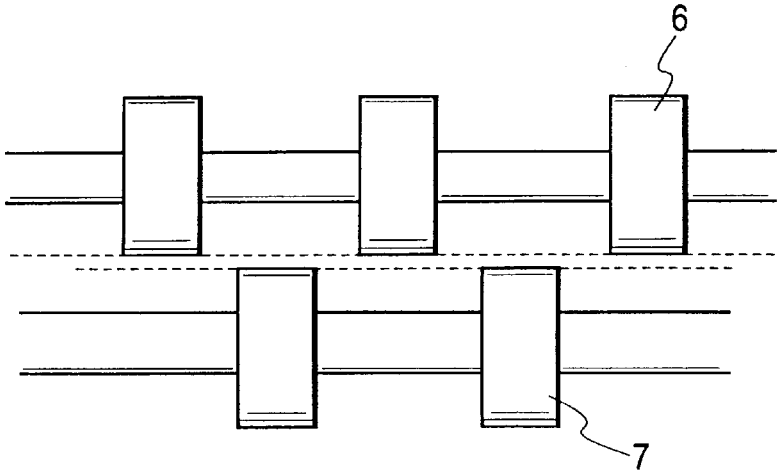
FIG. 14 shows the positional relation between a feeding roller and a separating roller during manual insertion.

The sheet thickness adjusting motor 11 is adjusted so that the feeding roller 6 and the separating roller 7 may assume the positions of FIG. 14 in which they do not overlap each other or may be spaced apart to a distance corresponding to the degree of a minimum sheet thickness.

The feeding motor 8 and the separating motor 9 both start to drive in the feeding direction. The manually inserted original F is conveyed without being subjected to the separating operation and therefore, an original folded into two or the like can be inputted smoothly.

The driving speeds of the sheet feeding motor 4, the feeding motor 8 and the separating motor 9 are set more slowly than during the automatic sheet feeding mode. This is because when the original is conveyed at a high speed at the moment when it has been manually inserted, the user is surprised and becomes liable to reflectively start the action of holding down the original unintentionally and this causes the skew feeding of the original.

Each motor conveys the original at a low speed in the conveying direction, and conveys it by a prescribed amount from the pre-registration sensor S3, whereafter the registration clutch 19 is connected and ordinary conveyance is started.

At this point of time, the user has already confirmed the start of the conveyance of the original and has released his band from the original, and no problem will arise even if the speed of the original increases.

As soon as the post-registration sensor S4 detects the original, the sheet feeding motor, the separating motor and the conveying motor complete their driving and do not start their next operations until the post-sheet feeding sensor S2 comes to detect no original.

By controlling each motor as described above, good manual sheet insertion and feeding which could not be realized by the prior-art means become possible.

(Seventh Embodiment)

In each of the above-described embodiments, the driving speed, direction and timing of the motor of each portion are individually changed, whereby precise separation and conveyance become possible for various originals, but there are many items of setting and it is very cumbersome to reset the original each time the original is changed.

Therefore, the memory switches 62, 63, etc. of the display portion 50 are effective.

The usually often used separating and conveying condition is set and the switch is operated before the start of sheet feeding, whereby the driving condition of each portion is reset.

Also, design is made such that the driving condition is changed from the memory 1 to the memory 2 during the re-separation and re-conveyance when bad conveyance or double feed is detected, whereby not only the above-described embodiment can be utilized very effectively, but also the efficiency of separation and conveyance rises.

(Eighth Embodiment)

In the above-described embodiments, description is made of an apparatus having an operation display portion, but regarding the operating portion, there is no problem even if display is effected on the display portion of an information processing apparatus (an external apparatus and external control condition setting means) not shown.

Also, a construction in which the operation setting of each portion is provided in the form of data and changed data is transferred to the present apparatus to thereby effect the operation setting is not restricted.

Thereby, the separating and conveying condition becomes controllable by a remote operation from the outside, and even when separation and conveyance cause abnormality, the user changes the operation setting without coming near the apparatus, whereby the continuation of separation and conveyance can be done.

(Ninth Embodiment)

While the foregoing embodiments are described as using a motor capable of step driving, the apparatus may be constructed by the use of an ordinarily rotation-controllable driving device. For example, a motor or the like using an encoder or the like to control rotation is also useful.

Also, in the above-described embodiments, the sheet feeding motor, the separating motor, the conveying motor, the original supporting table driving motor, the sheet thickness adjusting motor and the main conveying motor are all constructed independently of one another, but some of them can be constructed so as to operate by the use of clutches.

Particularly, the sheet feeding motor and the feeding motor can realize several embodiments even if they are driven at a time.

Thereby, the simplification of the apparatus construction and the simplification of control and operation become possible although the function is restricted.

Since design is made such that the feeding rotatable member, the conveying rotatable member and the separating rotatable member are driven by respective driving means, the setting of an appropriate separating and conveying condition conforming to various sheet materials and various conveying states becomes possible and an improvement in the separating and conveying performance can be achieved.

Also, since the rotatable members do not share driving means, drive transmitting means such as gears and belts can be eliminated and thus, the structure can be simplified and also the number of parts can be curtailed to thereby achieve a reduction in cost, the shortening of the assembling time, an improvement in serviceability, etc.

Also, the spacing between the conveying rotatable member and the separating rotatable member can be varied by the spacing adjusting means and therefore, separating and conveying performance conforming to sheet materials can be obtained.

Also, when the double feed or bad conveyance of sheet materials occurs, the setting of the control condition of the separating and conveying operation can be changed to feed the sheet materials again and prevent the error by the same cause, and finer and more accurate separation and conveyance become possible.

Further, such sheet material feeding apparatus can be applied to a sheet material processing apparatus or an image inputting apparatus to thereby provide an apparatus of high reliability.

(Tenth Embodiment)

Figure 15:
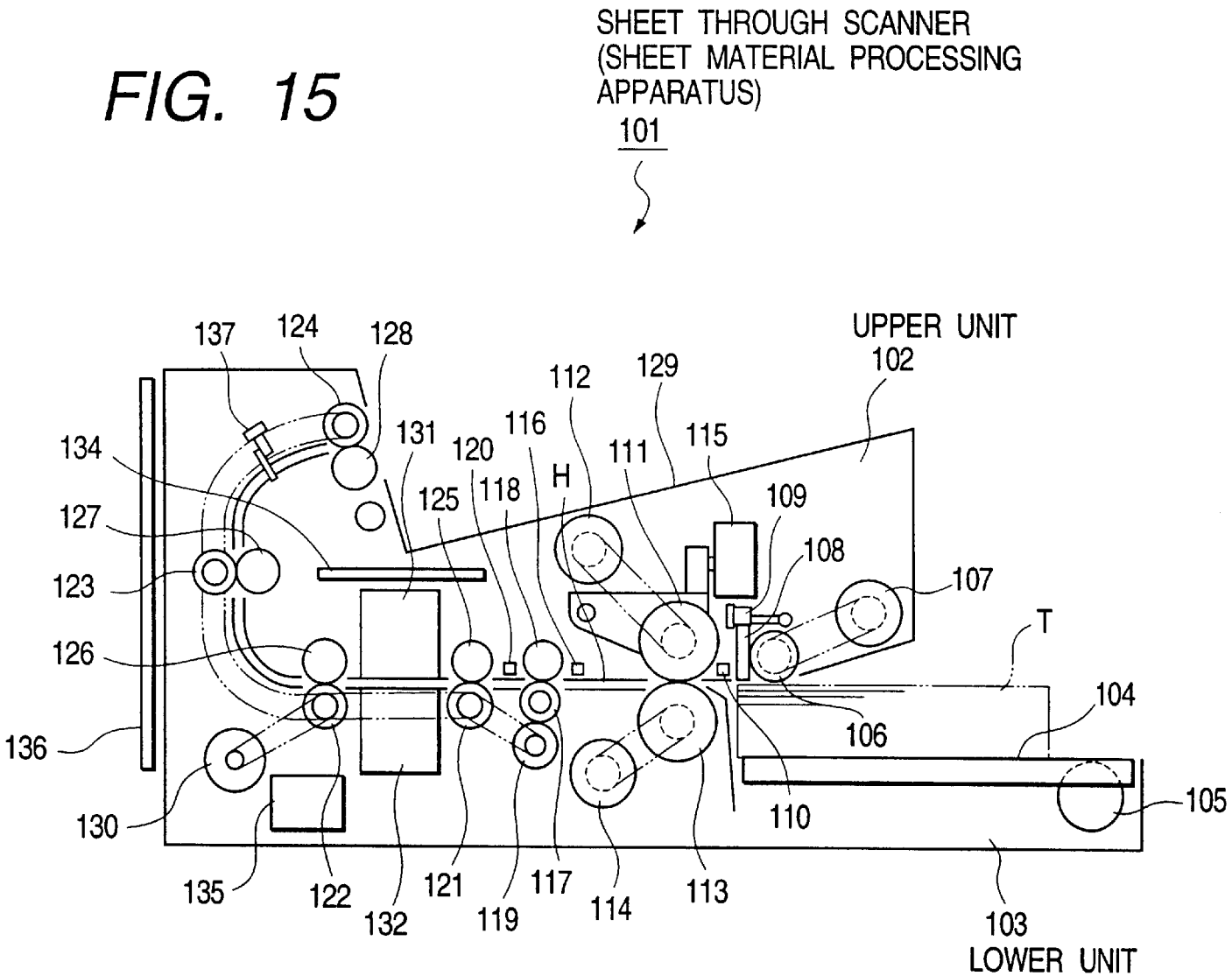
FIG. 15 is an illustration of the cross-sectional construction of a sheet material processing apparatus according to another embodiment of the present invention.
Figure 16:
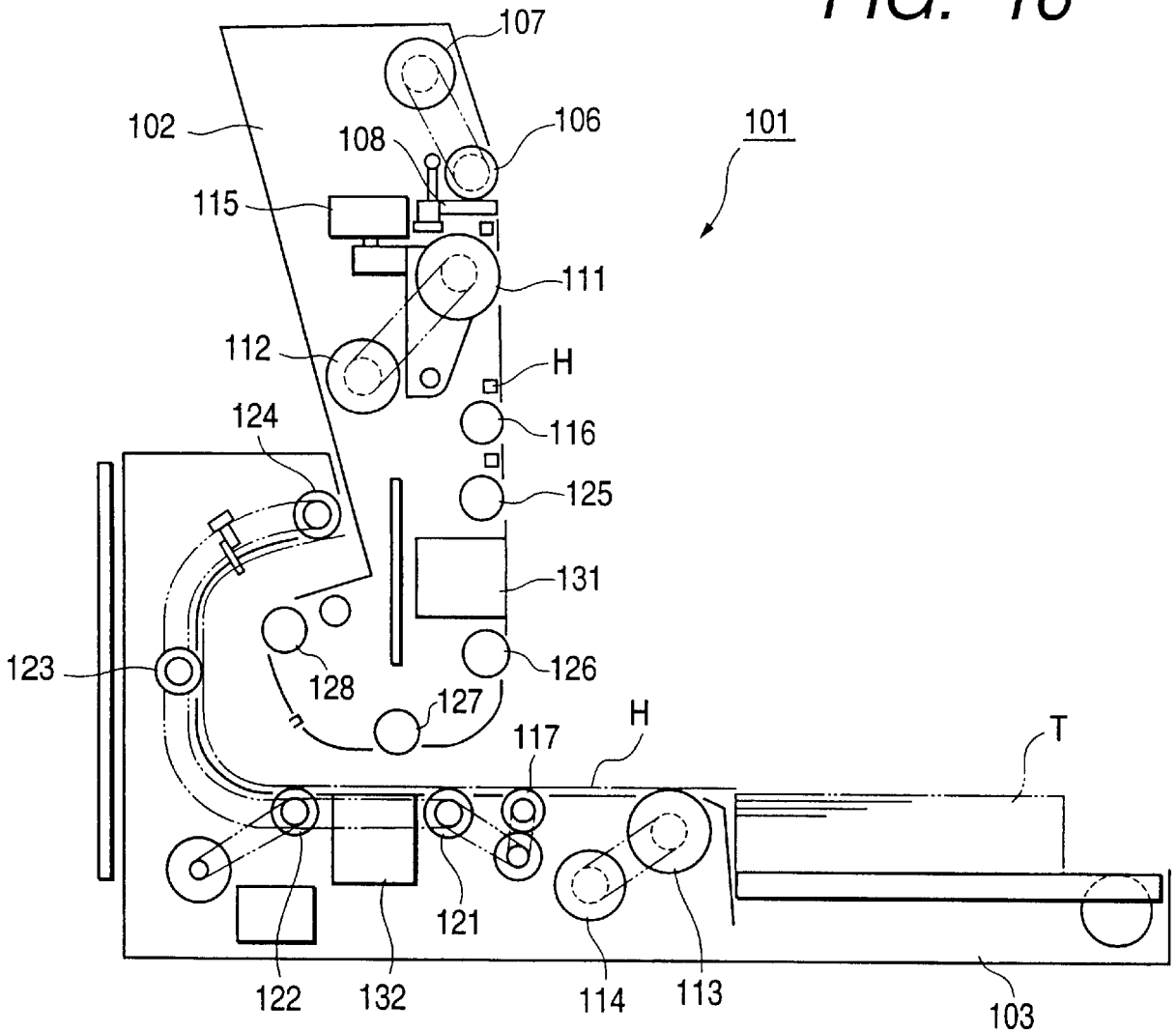
FIG. 16 is an illustration of the cross-sectional construction of the sheet material processing apparatus with the conveying path thereof opened.

FIG. 15 is an illustration of the cross-sectional construction in the side direction of a sheet through scanner 101 as a sheet material processing apparatus to which the present invention is applied. FIG. 16 shows a state in which by a cavernous mouth opening-closing system, an upper unit 102 has been pivotally moved with a conveyance path H as the boundary and has been separated from a lower unit 103 to open the conveyance path H.

The construction of each portion will now be described with reference to FIG. 15. The reference numeral 104 designates an original supporting table on which a bundle of originals T as sheet materials are set, and the reference numeral 105 denotes an original supporting table motor for moving up and down the original supporting table 104 in conformity with the number of remaining sheets of the bundle of originals T. The reference numeral 106 designates a pickup roller for feeding out the uppermost one of the bundle of originals T to a separating and feeding portion, and the reference numeral 107 denotes a pickup motor for rotatively driving the pickup roller 106.

The reference numeral 108 designates a pickup lever for detecting the upper surface position of the bundle of originals T, and the reference numeral 109 denotes a pickup sensor for detecting the movement of the pickup lever 108, and a position detected by this pickup sensor 109 is the upper surface stop position of the bundle of originals T fed out by the pickup roller 106. This position is determined for a separating and feeding mechanism which will be described later.

The reference numeral 110 designates a pre-sheet feeding sensor, the reference numeral 111 denotes a feeding roller, and the reference numeral 112 above it designates a feeding roller motor which is the drive source of the feeding roller 111.

Figure 17:
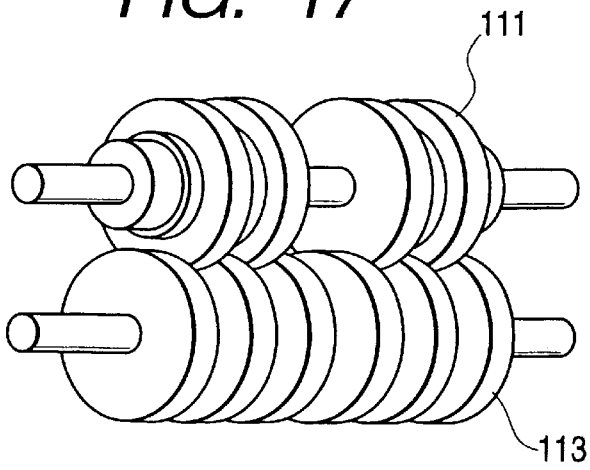
FIG. 17 shows the construction of a feeding roller and a separating roller.

The reference numeral 113 denotes a separating roller rotated in a direction opposite to the conveying direction, and the reference numeral 114 designates a separating motor which is the drive source of the separating roller 113. The feeding roller 111 and the separating roller 113, as shown in FIG. 17, is of a construction in which they overlap each other in a comb-tooth-like fashion, and are designed to adjust the amount of overlap by the thickness of an original conveyed and the rigidity of the original, and reliably separate only one original from the bundle of originals T and feed it.

The reference numeral 115 denotes a gap cam motor (spacing adjusting means) made into a cam construction for adjusting the aforementioned amount of overlap. The reference numeral 116 designates a pre-registration sensor for detecting the passage of the originals, the reference numeral 117 denotes a registration roller for scan timing, the reference numeral 118 designates a driven roller, the reference numeral 119 denotes a clutch for changing over the driving of the registration roller 117, and the reference numeral 120 designates a post-registration sensor for detecting the passage of the originals.

The reference numerals 121, 122, 123 and 124 denote conveying rollers driven in synchronism with one another, and driven rollers 125, 126, 127 and 128 are opposed to and urged against these conveying rollers 121, 122, 123 and 124, respectively.

The originals discharged from the conveyance path H are piled on a sheet discharging portion 129. The reference numeral 130 designates a main motor for driving a conveying system subsequent to the registration roller 117.

The reference numerals 131 and 132 denote scan reading units for scanning the front surface and back surface, respectively, of the original being conveyed, and each of these units is comprised of a close contact type lens array, a linear light source, an image sensor, etc.

The reference numeral 134 designates a sub CPUA for controlling the movement of driving means provided in the aforedescribed upper unit 102 with the conveyance path H as the boundary, the reference numeral 135 denotes a sub CPUB for controlling the movement of driving means provided in the aforedescribed lower unit 103, and the reference numeral 136 designates a main CPU for effecting main control.

Figure 18:
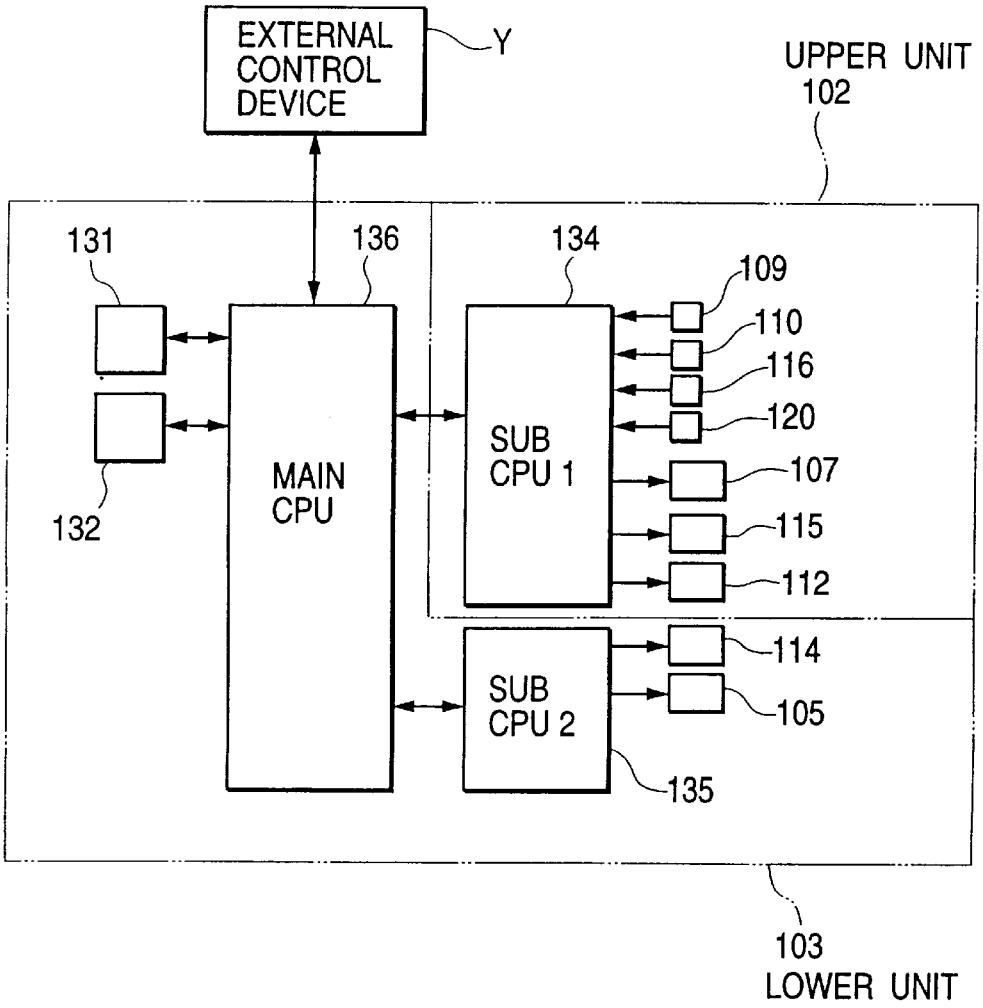
FIG. 18 is a control block diagram of the sheet material processing apparatus.
Figure 19:
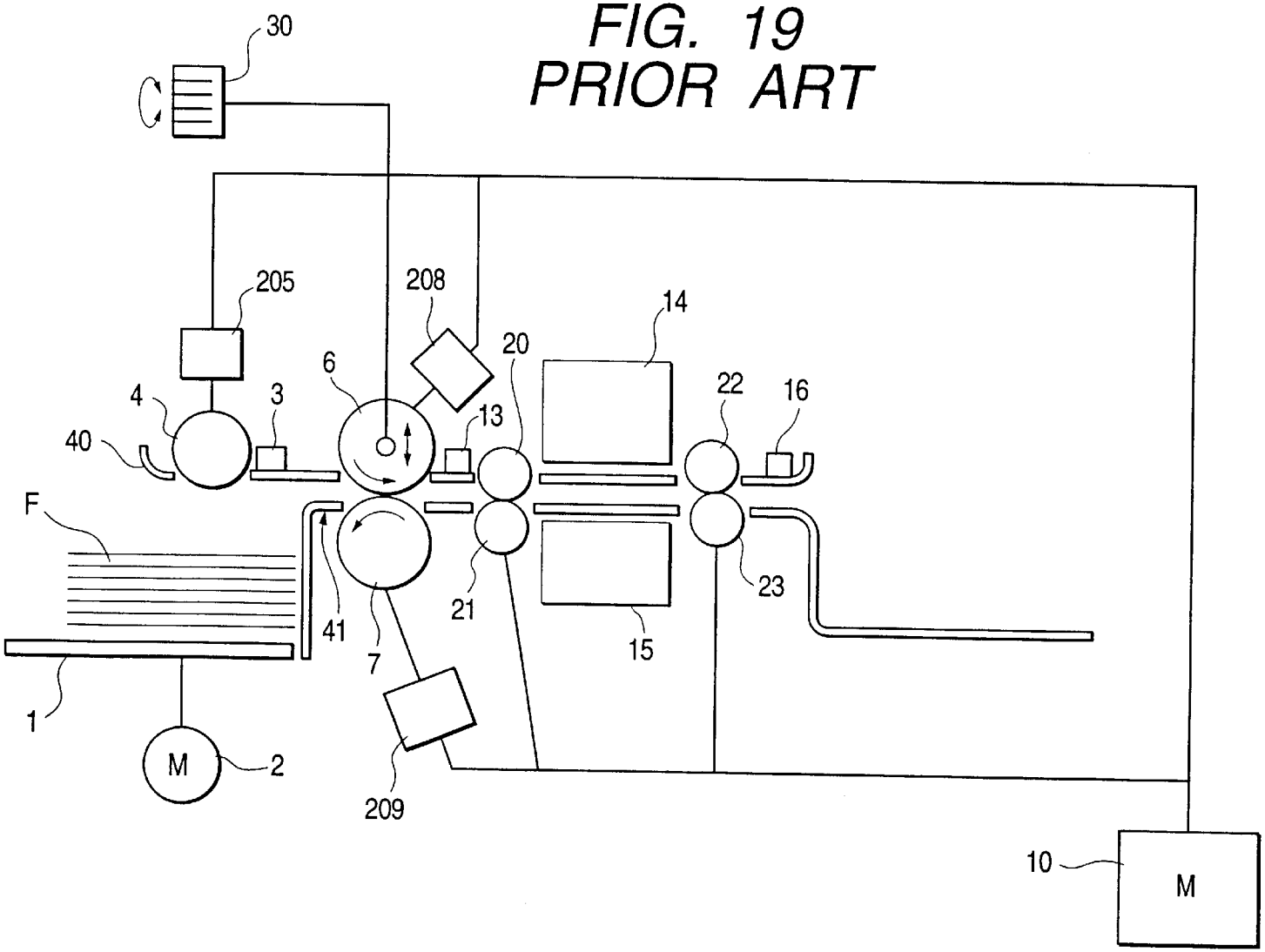
FIG. 19 PRIOR ART
FIG. 19 schematically shows the construction of the essential portions of an image reading apparatus according to the prior art.
Figure 20:
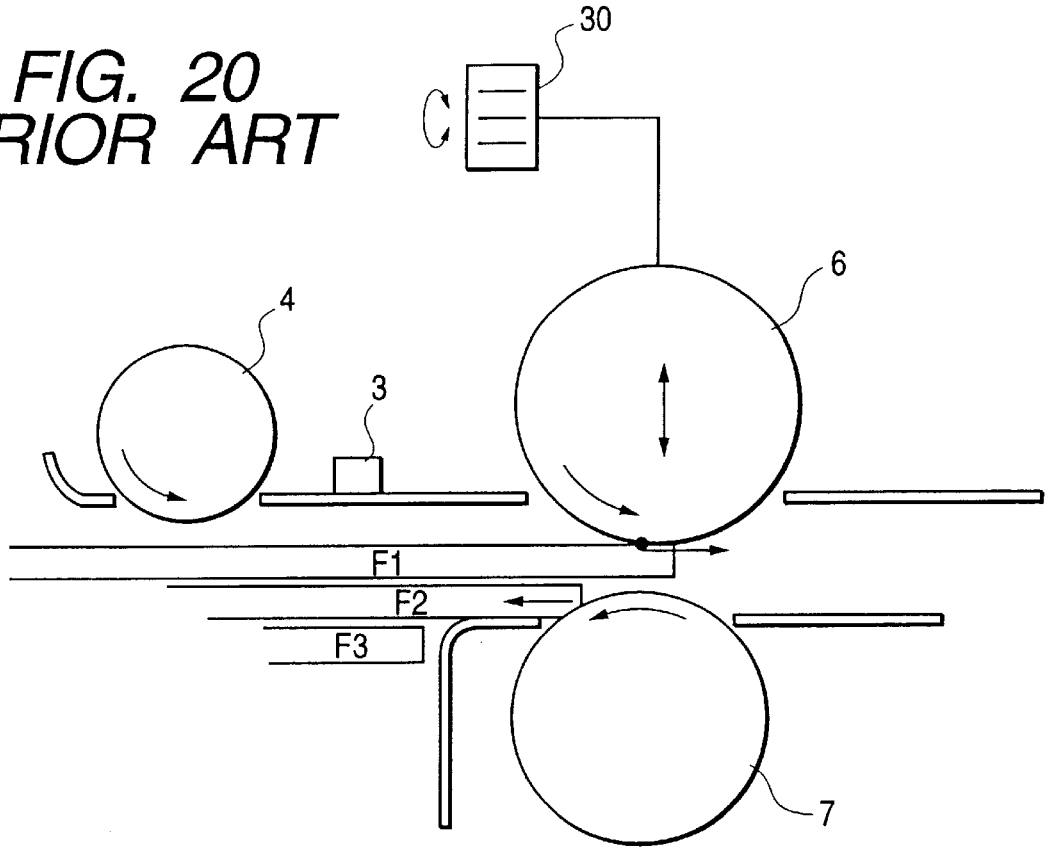
FIG. 20 PRIOR ART
FIG. 20 illustrates an original separating operation.
Figure 21:
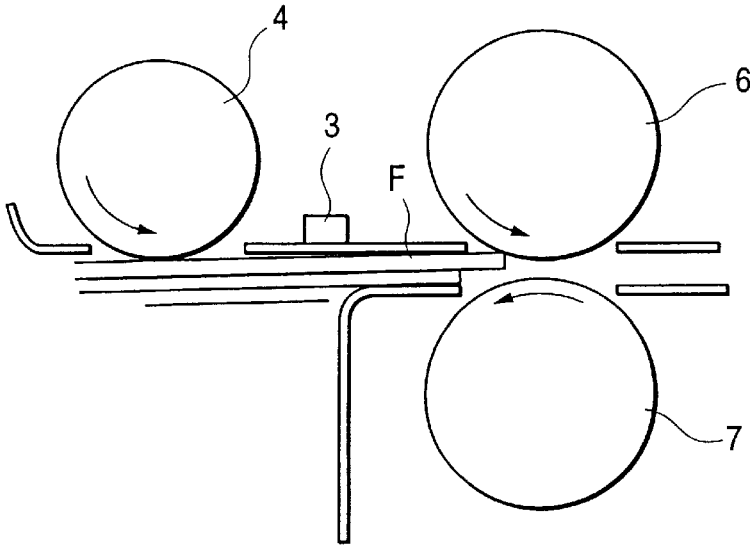
FIG. 21 PRIOR ART
FIG. 21 illustrates a situation in which an original does not enter.
Figure 22:
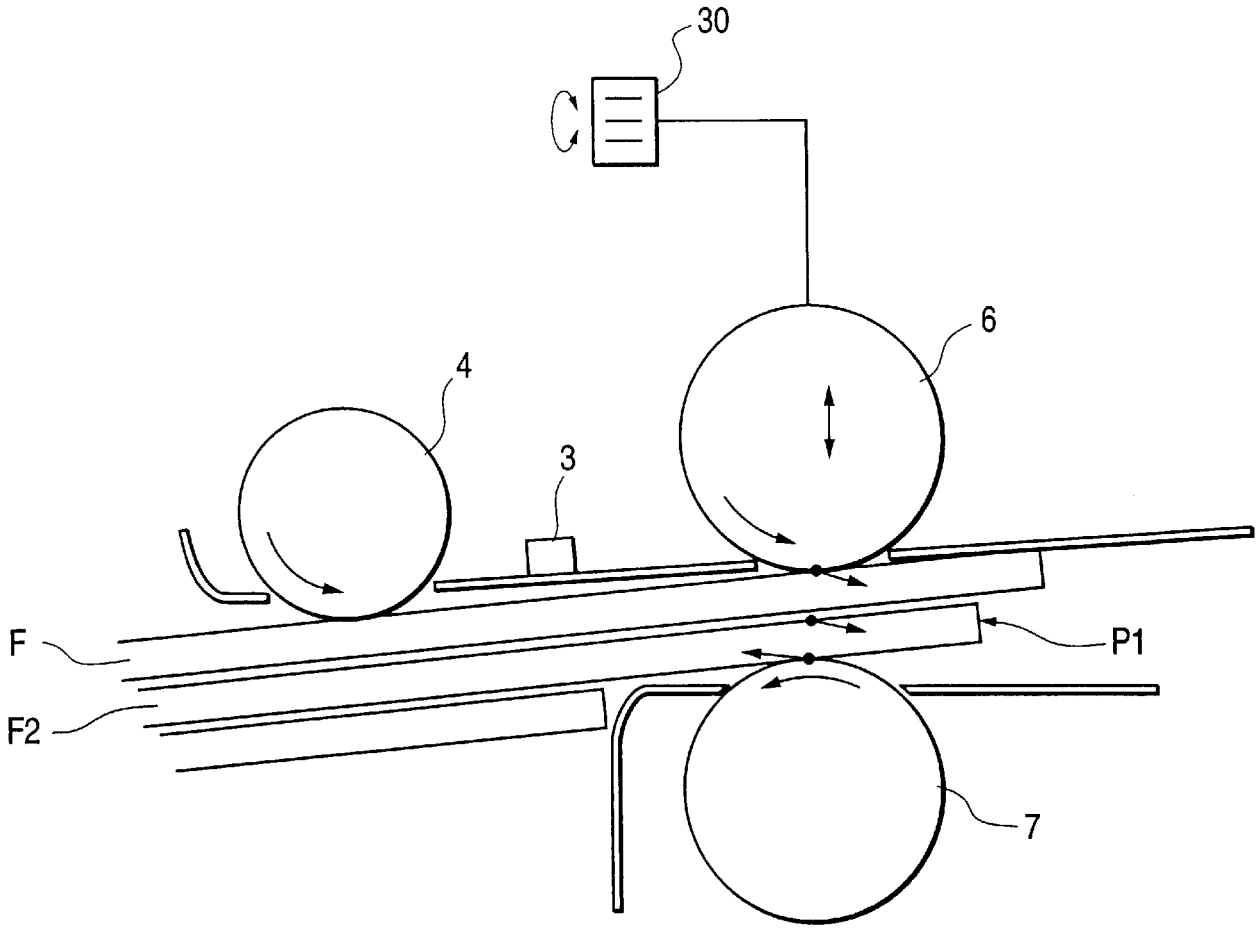
FIG. 22 PRIOR ART
FIG. 22 illustrates the double feeding state of originals.

Description of the control relation will now be made with reference to the control block diagram of FIG. 18. In this embodiment, an external control device Y (computer or the like) for effecting the preservation and editing of data scanned by the sheet through scanner 101 is present discretely from the sheet through scanner 101.

In the upper unit 102 of the sheet through scanner 101, the control of the pickup sensor 109, the pre-sheet feeding sensor 110, the pre-registration sensor 116, the post-registration sensor 120, the pickup motor 107, the gap cam motor 115 and the feeding roller motor 112 is effected by the sub CPUA 134.

Also, in the lower unit 103, the control of the separating motor 114 and the original supporting table motor 105 is effected by the sub CPUB 135.

In the main CPU 136, the control of the reading units 131, 132, etc. is effected.

Pulse motors are used as motors as drive sources for driving the aforedescribed various conveying means, and the driving speeds, synchronization, driving timing, etc. of the respective sheet material conveying means are controlled by the CPU.

The operation of each portion in the scanner operation will now be described with reference to FIG. 15. The bundle of originals T piled on the original supporting table 104 is moved up by the original supporting table motor 105. At predetermined timing after the upper surface of the bundle of originals T has contacted with the pickup lever 108 and it has been detected by the pickup sensor 109, the driving of the pickup motor 107 is effected and the pickup roller 106 is rotated at a prescribed speed to thereby feed the original to the separating and feeding portion.

Regarding the feeding of the second and subsequent originals, the bundle of originals T on the original supporting table 104 is already moved up to a predetermined position as previously described and therefore, at the timing whereat the trailing end of the original being conveyed has been detected by the post-registration sensor 120, the pickup roller 106 is driven and sheet feeding is effected.

Also, by the same signal of the post-registration sensor 120, the driving of the separating motor 114 and the main motor 130 is started at a prescribed speed, and the separating roller 113 and the conveying rollers 121, 122, 123 and 124 begin to be rotated.

When the leading end of the original is detected by the pre-sheet feeding sensor 110, the feeding roller 111 is moved to a position of an amount of overlap suiting the kind of paper of the original by the gap cam motor 115, and the feeding roller 111 also starts to be driven at a prescribed speed.

By such a construction, the uppermost original of the bundle of originals T is separated and fed to the conveyance path H.

Thereafter, the passage of the leading end of the original is detected by the pre-registration sensor 116 and the clutch 119 is connected to the registration roller 117, whereby the driving of the main motor 130 is transmitted.

When in this state, the data communication with the external control device Y processing and making the most of the scan data and the processing on the external control device Y side are not yet completed, the clutch 119 is disconnected at a position whereat the leading end of the original does not come to the post-registration sensor 120 so that the scanning of the data of the conveyed original may not be started, and the driving of the registration roller 117 is cut off to thereby make the original wait.

If in a state in which the data can be scanned, the conveyance of the original is effected by the conveying rollers 121, 122, 123 and 124, and by the post-registration sensor 120, the scan starting timing is fitted from the conveyance speed and the distance to the scanning position, and the reading (scanning) of the image information of the front surface is effected by the reading unit 131 and the reading (scanning) of the image information of the back surface is effected by the reading unit 132.

Also, in accordance with the signals, the driving of the pickup roller 106 and the feeding roller 111 is stopped so that the feeding roller 111 may be rotated with the separating roller 113.

The timing of the stoppage of scanning is taken by the post-registration sensor 120.

The original of which the image information has been read is discharged from the conveyance path H and is placed on the sheet discharging portion 129. Further, the exhaustion of the originals on the original supporting table 104 is detected by the pickup lever 108 and the sheet discharge sensor 137 detects the passage of the last original, whereafter the driving of all is stopped.

As described above, the sheet material conveying means (driving means) provided in the upper unit 102 and the lower unit 103 are driven independently of each other, and it becomes unnecessary to effect the transmission of the driving force between the upper and lower units, and the connecting gear portion as used in the prior art can be eliminated.

Accordingly, the construction of the driving force transmitting means with the sheet material conveying means (driving means) and the drive source in the sheet through scanner 101 adopting the cavernous mouth opening-closing system can be simplified, and the curtailment of the number of parts and improvements in assembling property and space efficiency have become possible.

Also, by making the drive sources of the upper and lower units independent of each other, it becomes possible to drive each sheet material conveying means under an optimum condition, and the stable feeding and conveyance of sheet materials become possible, and it also becomes possible to improve the sheet material processing performance.

That is, in dependently of the conveyance speed of the originals in the conveying portion wherein the image reading means set on the basis of the scan resolution is disposed, the feeding speed of the originals in the separating and feeding portion is set to an optimum speed and a feeding speed conforming to the kind of the original is obtained, whereby it also becomes possible to effect stable feeding and improve the throughput (original processing capability).

A pulse motor has been used as each motor hitherto described because it has the connections of the drive starting timing and the driving speed, but as another embodiment, even when an AC motor and a DC motor are used, it is also possible to adopt a construction in which their speeds are controllable by an encoder or the like, and to substitute a clutch for the ON and OFF of the driving of each portion.

The selection of the motors is determined by necessary torque, control characteristic, assembling property, cost, etc., and with these factors taken into account, the above-described construction has been adopted in the embodiments of the present invention.

It is also possible to replace the separating roller 113 in the construction of the separating and feeding portion by a friction pad or the like, and the invention is not restricted to the constructions of the embodiments.

In addition, in the sheet material processing apparatus of this embodiment, the image information of the originals is read, but it is also possible to apply the present invention to an apparatus such as a printer or a copying apparatus which is provided with image forming means for forming images on sheet materials.

As described with respect to the embodiments of the present invention, according to the sheet material processing apparatus adopting the cavernous mouth opening-closing system to which the present invention is applied, the construction of the driving force transmitting means with the sheet material conveying means and the drive sources can be simplified, and the curtailment of the number of parts and improvements in assembling property and space efficiency become possible.

Also, by making the drive sources of the upper and lower units independent of each other, it becomes possible to drive each sheet material conveying means under an optimum condition, and the stable feeding and conveyance of the sheet materials become possible, and it also becomes possible to improve the sheet material processing performance.

What is claimed is:

1. A sheet material feeding apparatus having a feeding rotatable member for feeding a sheet material from a predetermined feeding position, and separating and conveying means for conveying the sheet material fed by said feeding rotatable member and separating double-fed sheet materials, wherein said separating and conveying means includes a conveying rotatable member rotated in a sheet material conveying direction, and a separating rotatable member for pinching said sheet material between itself and said conveying rotatable member, and rotated in a direction opposite to said sheet material conveying direction, wherein said feeding rotatable member, said conveying rotatable member and said separating rotatable member are driven by respective independent driving means, and wherein at least two of said feeding rotatable member, said conveying rotatable member and said separating rotatable member are driven in non-synchronism with each other.

2. A sheet material feeding apparatus having a feeding rotatable member for feeding a sheet material from a predetermined feeding position, and separating and conveying means for conveying the sheet material fed by said feeding rotatable member and separating double-fed sheet materials, wherein said separating and conveying means includes a conveying rotatable member rotated in a sheet material conveying direction, and a separating rotatable member for pinching said sheet material between itself and said conveying rotatable member, and rotated in a direction opposite to said sheet material conveying direction, wherein said feeding rotatable member, said conveying rotatable member and said separating rotatable member are driven by respective independent driving means, and wherein said apparatus has driving method switching means for switching at least two of said feeding rotatable member, said conveying rotatable member and said separating rotatable member to a case where they are driven in synchronism with each other and a case where they are driven in non-synchronism with each other.

3. A sheet material feeding apparatus according to claim 2, wherein said apparatus has a manually inserting mode for feeding a manually inserted sheet material, and, in said manually inserting mode, said sheet material supporting portion is moved so that said manually inserted sheet material may be disposed at the predetermined feeding position, and said feeding rotatable member, said conveying rotatable member and said separating rotatable member are rotatable in the sheet material conveying direction at the same peripheral velocity.

4. A sheet material feeding apparatus according to claim 3, wherein, in the manually inserting mode, the spacing between said conveying rotatable member and said separating rotatable member is set to the order of the minimum value of the thickness of the sheet material.

5. A sheet material feeding apparatus according to claim 3, wherein, in the manually inserting mode, at the start of the feeding, the sheet material is conveyed at a speed lower than the predetermined conveyance speed of the sheet material when the sheet materials supported on said sheet material supporting portion are fed, and is accelerated to said predetermined conveyance speed.

6. A sheet material feeding apparatus according to claim 4, wherein, in the manually inserting mode, the spacing between said conveying rotatable member and said separating rotatable member is made greater than that in the initial state after the sheet material has arrived at conveying means located downstream of said separating and conveying means with respect to the sheet material conveying direction.

7. A sheet material feeding apparatus having a feeding rotatable member for feeding a sheet material from a predetermined feeding position, and separating and conveying means for conveying the sheet material fed by said feeding rotatable member and separating double-fed sheet materials, wherein said separating and conveying means includes a conveying rotatable member rotated in a sheet material conveying direction, and a separating rotatable member for pinching said sheet material between itself and said conveying rotatable member, and rotated in a direction opposite to said sheet material conveying direction, wherein said feeding rotatable member, said conveying rotatable member and said separating rotatable member are driven by respective independent driving means, and wherein a case where at least two of said feeding rotatable member, said conveying rotatable member and said separating rotatable member are driven in synchronism with each other and a case where at least two of said feeding rotatable member, said conveying rotatable member and said separating rotatable member are driven in non-synchronism with each other are switched in the process of the separating and conveying operation.

8. A sheet material feeding apparatus having a feeding rotatable member for feeding a sheet material from a predetermined feeding position, and separating and conveying means for conveying the sheet material fed by said feeding rotatable member and separating double-fed sheet materials, wherein said separating and conveying means includes a conveying rotatable member rotated in a sheet material conveying direction, and a separating rotatable member for pinching said sheet material between itself and said conveying rotatable member, and rotated in a direction opposite to said sheet material conveying direction, wherein said feeding rotatable member, said conveying rotatable member and said separating rotatable member are driven by respective independent driving means, wherein said apparatus has spacing adjusting means for changing the spacing between said conveying rotatable member and said separating rotatable member, and wherein, in the separating and conveying operation for the original, the spacing between said conveying rotatable member and said separating rotatable member is changed so that the varying speed of said spacing may vary in conformity with said spacing.

9. A sheet material feeding apparatus having a feeding rotatable member for feeding a sheet material from a predetermined feeding position, and separating and conveying means for conveying the sheet material fed by said feeding rotatable member and separating double-fed sheet materials, wherein said separating and conveying means includes a conveying rotatable member rotated in a sheet material conveying direction, and a separating rotatable member for pinching said sheet material between itself and said conveying rotatable member, and rotated in a direction opposite to said sheet material conveying direction, wherein said feeding rotatable member, said conveying rotatable member and said separating rotatable member are driven by respective independent driving means, wherein said apparatus has spacing adjusting means for changing the spacing between said conveying rotatable member and said separating rotatable member, and wherein the spacing between said conveying rotatable member and said separating rotatable member is changed with the separating and conveying operation for the original and correction is effected so that said spacing may assume a predetermined size, and the amount of the correction is changed in conformity with said spacing.

10. A sheet material feeding apparatus having a feeding rotatable member for feeding a sheet material from a predetermined feeding position, and separating and conveying means for conveying the sheet material fed by said feeding rotatable member and separating double-fed sheet materials, wherein said separating and conveying means includes a conveying rotatable member rotated in a sheet material conveying direction, and a separating rotatable member for pinching said sheet material between itself and said conveying rotatable member, and rotated in a direction opposite to said sheet material conveying direction, wherein said feeding rotatable member, said conveying rotatable member and said separating rotatable member are driven by respective independent driving means, wherein said apparatus has spacing adjusting means for changing the spacing between said conveying rotatable member and said separating rotatable member, and wherein, when a plurality of sheet materials are to be fed, in case where a sheet material next to a sheet material which has passed said separating and conveying means is already pinched by said separating and conveying means, the spacing between said conveying rotatable member and said separating rotatable member is made smaller while said conveying rotatable member is reversely rotated.

11. A sheet material feeding apparatus having a feeding rotatable member for feeding a sheet material from a predetermined feeding position, and separating and conveying rotatable member and separating double-fed sheet materials, wherein said separating and conveying means includes a conveying rotatable member rotated in a sheet material conveying direction, and a separating rotatable member for pinching said sheet material between itself and said conveying rotatable member, and rotated in a direction opposite to said sheet material conveying direction, wherein said feeding rotatable member, said conveying rotatable member and said separating rotatable member are driven by respective independent driving means, wherein, when the sheet material does not normally pass the separating and conveying means and the sheet material remains at the feeding position, the setting of the control conditions of the separating and conveying means is changed and the next separating and conveying operation is performed.

12. A sheet material feeding apparatus having a feeding rotatable member for feeding a sheet material from a predetermined feeding position, and separating and conveying means for conveying the sheet material fed by said feeding rotatable member and separating double-fed sheet materials, wherein said separating and conveying means includes a conveying rotatable member rotated in a sheet material conveying direction, and a separating rotatable member for pinching said sheet material between itself and said conveying rotatable member, and rotated in a direction opposite to said sheet material conveying direction, wherein said feeding rotatable member, said conveying rotatable member and said separating rotatable member are driven by respective independent driving means, wherein said apparatus has spacing adjusting means for changing the spacing between said conveying rotatable member and said separating rotatable member, wherein said apparatus has double feed detecting means for detecting the double feed of sheet materials downstream of said separating and conveying means with respect to the direction of conveyance of the sheet material, wherein the separating and conveying operation for said sheet material is performed while the spacing between said conveying rotatable member and said separating rotatable member is changed, by said spacing adjusting means, and wherein, when double feed is detected by said double feed detecting means, said feeding rotatable member and said conveying rotatable member are stopped, and the spacing between said conveying rotatable member and said separating rotatable member is restored to its initial state while said separating rotatable member is rotated in a direction opposite to the sheet material conveying direction, whereby the double-fed sheet materials are discharged from the separating and conveying means.

13. A sheet material feeding apparatus according to claim 12, wherein, when the feeding of the sheet material is to be effected again after said double feed detecting means has detected double feed, the setting of the control conditions of the separating and conveying operation is made different from that when double feed occurs.

14. A sheet material feeding apparatus according to claim 13, characterized in that the synchronous and non-synchronous relationship of the driving of at least two of said feeding rotatable member, said conveying rotatable member and said separating rotatable member is changed during the occurrence of double feed and after the detection of double feed.

15. A sheet material feeding apparatus having a feeding rotatable member for feeding a sheet material from a predetermined feeding position, and separating and conveying means for conveying the sheet material fed by said feeding rotatable member and separating double-fed sheet materials, wherein said separating and conveying means includes a conveying rotatable member rotated in a sheet material conveying direction, and a separating rotatable member for pinching said sheet material between itself and said conveying rotatable member, and rotated in a direction opposite to said sheet material conveying direction, wherein said feeding rotatable member, said conveying rotatable member and said separating rotatable member are driven by respective independent driving means, wherein said apparatus has spacing adjusting means for changing the spacing between said conveying rotatable member and said separating rotatable member, wherein said apparatus has double feed detecting means for detecting the double feed of sheet materials downstream of said separating and conveying means with respect to the sheet material conveying direction, wherein the separating and conveying operation for said sheet material is performed while the spacing between said conveying rotatable member and said separating rotatable member is changed by said spacing adjusting means, and wherein, when double feed is detected by said double feed detecting means, the spacing between said conveying rotatable member and said separating rotatable member is restored to its initial state while said feeding rotatable member and said conveying rotatable member are rotated in a direction opposite to the sheet material conveying direction, whereby the sheet materials are discharged from said separating and conveying means.

16. A sheet material feeding apparatus having a feeding rotatable member for feeding a sheet material from a predetermined feeding position, and separating and conveying means for conveying the sheet material fed by said feeding rotatable member and separating double-fed sheet materials, wherein said separating and conveying means includes a conveying rotatable member rotated in a sheet material conveying direction, and a separating rotatable member for pinching said sheet material between itself and said conveying rotatable member, and rotated in a direction opposite to said sheet material conveying direction, wherein said feeding rotatable member, said conveying rotatable member and said separating rotatable member are driven by respective independent driving means, wherein said apparatus has a plurality of separating conveying modes in which the settings of the control conditions of the sheet material separating and conveying operation are different, and mode switching means for switching said separating and conveying modes.

17. A sheet material feeding apparatus having a feeding rotatable member for feeding a sheet material from a predetermined feeding position, and separating and conveying means for conveying the sheet material fed by said feeding rotatable member and separating double-fed sheet materials, wherein said separating and conveying means includes a conveying rotatable member rotated in a sheet material conveying direction, and a separating rotatable member for pinching said sheet material between itself and said conveying rotatable member, and rotated in a direction opposite to said sheet material conveying direction, wherein said feeding rotatable member, said conveying rotatable member and said separating rotatable member are driven by respective independent driving means, wherein, in the sheet material separating and conveying operation, said apparatus has an automatic adjusting mode for automatically adjusting the space between said conveying rotatable member and said separating rotatable member by said spacing adjusting means in the sheet material separating and conveying operation, a manual adjusting mode for inputting and setting the spacing between said conveying rotatable member and said separating rotatable member in the sheet material separating and conveying operation, and spacing adjusting mode switching means for switching said automatic adjusting mode and said manual adjusting mode.

18. A sheet material feeding apparatus according to claim 17, wherein said apparatus has reference value displaying means for displaying the adjusted value of the spacing between said conveying rotatable member and said separating rotatable member in the automatic adjusting mode when the mode is changed over to said manual adjusting mode.

19. A sheet material feeding apparatus having a feeding rotatable member for feeding a sheet material from a predetermined feeding position, and separating and conveying means for conveying the sheet material fed by said feeding rotatable member and separating double-fed sheet materials, wherein said separating and conveying means includes a conveying rotatable member rotated in a sheet material conveying direction, and a separating rotatable member for pinching said sheet material between itself and said conveying rotatable member, and rotated in a direction opposite to said sheet material conveying direction, wherein said feeding rotatable member, said conveying rotatable member and said separating rotatable member are driven by respective independent driving means further having:

control condition setting means capable of setting the control conditions of the sheet material separating and conveying operation; and control condition storing means for storing the set substance by said control condition setting means.

20. A sheet material feeding apparatus according to claim 19, wherein, in the sheet material separating and conveying operation based on predetermined control conditions, when the sheet material is to be again fed, the control conditions are changed on the basis of the set substance stored in said control condition storing means.

21. A sheet material feeding apparatus having a feeding rotatable member for feeding a sheet material from a predetermined feeding position, and separating and conveying means for conveying the sheet material fed by said feeding rotatable member and separating double-fed sheet materials, wherein said separating and conveying means includes a conveying rotatable member rotated in a sheet material conveying direction, and a separating rotatable member for pinching said sheet material between itself and said conveying rotatable member, and rotated in a direction opposite to said sheet material conveying direction, wherein said feeding rotatable member, said conveying rotatable member and said separating rotatable member are driven by respective independent driving means, and wherein communication means is provided between said sheet material feeding apparatus and an external apparatus, and said external apparatus is provided with external control condition setting means for setting the control conditions of the sheet material separating and conveying operation through said communication means.

22. A sheet material feeding apparatus according to any one of claims 1 to 7, 8 to 18 and 3 to 21, wherein each of said conveying rotatable member and said separating rotatable member comprises a plurality of rollers disposed in a comb-tooth-like form on the same shaft, and the rollers constituting said conveying rotatable member and the rollers constituting said separating rotatable member are axially alternately disposed.

23. A sheet material processing apparatus having a sheet material feeding portion for feeding sheet materials, and a sheet material processing portion for effecting predetermined processing on the fed sheet materials, wherein the sheet material feeding apparatus according to any one of claims 1 to 7, 8 to 18, and 3 to 21 is provided in said sheet material feeding portion.

24. An image reading apparatus provided with an original feeding portion for feeding a sheet-like original, and an image reading portion for reading an image on the fed original, wherein the sheet material feeding apparatus according to any one of claims 1 to 6, 18 to 18, and 3 to 21 provided in the original feeding portion.

25. An image reading apparatus according to claim 24, wherein the separating and conveying speed for the original is set independently of the reading speed in said image reading portion.

26. A sheet material processing apparatus which is divided into an upper unit and a lower unit with a conveyance path for sheet materials as the boundary and in which said upper unit can be moved from said lower unit to thereby open said conveyance path, comprising:

a plurality of sheet material conveying means disposed in each of said upper unit and said lower unit;

a plurality of drive sources corresponding to respective ones of said sheet material conveying means; and control means for controlling said plurality of drive sources independently of one another to thereby effect the sheet material conveying operation by said sheet material conveying means.

27. A sheet material processing apparatus according to claim 26, wherein said upper unit is disposed for pivotal movement relative to said lower unit, the sheet material conveying means provided in said upper unit are driven by a drive source provided in said upper unit, and the sheet material conveying means provided in said lower unit are driven by a drive source provided in said lower unit.

28. A sheet material processing apparatus according to claim 26, wherein said upper unit is provided with sheet feeding means for effecting the feeding of the sheet material from a sheet feeding portion as sheet material conveying means, and said lower unit is provided with conveying means for conveying the sheet material as sheet conveying means in a conveyance path downstream of the sheet feeding portion.

29. A sheet material processing apparatus according to claim 26, wherein image reading means for reading the image information of the conveyed sheet material is provided in the conveyance path downstream of said sheet feeding portion.

30. A sheet material processing apparatus according to claim 26, wherein image forming means for forming an image on the conveyed sheet material is provided in the conveyance path downstream of said sheet feeding portion.

31. A sheet feeding apparatus comprising:

a feeding rotatable member for feeding sheets supported on a sheet supporting table;

a conveying rotatable member for conveying the sheets fed by said feeding rotatable member in a predetermined direction toward a sheet processing portion;

a separating rotatable member disposed in opposed relationship with said conveying rotatable member for conveying the sheets in a direction opposite to said predetermined direction;

driving means for driving said feeding rotatable member, said conveying rotatable member and said separating rotatable member independently of one another;

spacing adjusting means for changing the spacing between the rotary shaft of said conveying rotatable member and the rotary shaft of said separating rotatable member; and means for controlling so as to increase the spacing between said conveying rotatable member and said separating rotatable member after the leading end of the sheet fed by said feeding rotatable member has arrived at the opposed portion of said conveying rotatable member and said separating rotatable member.

32. A sheet feeding apparatus according to claim 31, wherein, when it is detected that the leading end of the sheet has passed between said conveying rotatable member and said separating rotatable member, the spacing between said two rotatable members is controlled so as to be maintained in a predetermined state.

33. A sheet feeding apparatus according to claim 31, wherein said conveying rotatable member is driven so as to be rotated at a low speed before the sheet arrives at said conveying rotatable member, and to be rotated at a predetermined speed higher than said low speed after the sheet has arrived at said conveying rotatable member.

34. A sheet feeding apparatus according to claim 31, wherein said separating rotatable member is driven so as to rotate earlier than said conveying rotatable member.

35. A sheet feeding apparatus according to claim 31, wherein said rotatable members are driven by respective independent pulse motors.

36. A sheet material feeding apparatus having a feeding rotatable member for feeding a sheet material from a predetermined feeding position, and separating and conveying means for conveying the sheet material fed by said feeding rotatable member and separating double-fed sheet materials, wherein said separating and conveying means includes a conveying rotatable member rotated in a sheet material conveying direction, and a separating rotatable member cooperating with said conveying rotatable member, to pinch said sheet and said separating rotatable member rotated in a direction opposite to said sheet material conveying direction, wherein said feeding rotatable member, said conveying rotatable member and said separating rotatable member are driven by respective independent driving means, wherein, in the separating and conveying operation of one sheet material, said feeding rotatable member and said separating rotatable member are driven in steps in synchronous synchronizes with each other.

37. A sheet material feeding apparatus according to claim 36, further having driving method switching means for switching each driving phase of said conveying rotatable member and said separating rotatable member to a case where they are driven in synchronism with each other and a case where they are driven in non-synchronism with each other.

38. A sheet material feeding apparatus according to claim 37, wherein an operation of said driving method switching means is performed in a process of the separating and conveying operation.

* * * * *

UNITED STATES PATENT AND TRADEMARK OFFICE

CERTIFICATE OF CORRECTION

PATENT NO. : 6,234,470 B1
DATED : May 22, 2001
INVENTOR(S) : Katsuhiko Okitsu et al.

It is certified that error appears in the above-identified patent and that said Letters Patent is hereby corrected as shown below:

Column 13,
Line 34, "pl," should read -- pl, --.

Column 23,
Line 4, "in dependently" should read -- independently --.

Column 26,
Line 27, "means," should read -- means, and --.

Column 27,
Line 67, "means," should read -- means, and --.

Column 28,
Line 18, "means," should read -- means, and --.
Line 20, "has" should read -- has: --.
Line 49, "direction," should read -- direction, and --.

Column 29,
Lines 21, 33 and 39" claims 1 to 7, 8 to 18 and 3 to 21," should read -- claims 1 to 21, --.

Column 31,
Line 8, "means," should read -- means, and --.

Signed and Sealed this

Sixteenth Day of April, 2002

*Attest:*

*Attesting Officer*

JAMES E. ROGAN
*Director of the United States Patent and Trademark Office*